US007175246B2

(12) United States Patent
Niekawa et al.

(10) Patent No.: US 7,175,246 B2
(45) Date of Patent: Feb. 13, 2007

(54) INKJET RECORDING DEVICE

(75) Inventors: Yakihiro Niekawa, Hachioji (JP); Tsutomu Yoneyama, Hachioji (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 255 days.

(21) Appl. No.: 10/825,555

(22) Filed: Apr. 14, 2004

(65) Prior Publication Data

US 2004/0207670 A1 Oct. 21, 2004

(30) Foreign Application Priority Data

Apr. 18, 2003 (JP) ..... 2003-114475
Apr. 18, 2003 (JP) ..... 2003-114496

(51) Int. Cl.
*B41J 2/14* (2006.01)

(52) U.S. Cl. ..... 347/14; 347/41; 347/16; 347/15

(58) Field of Classification Search ..... 347/9, 347/14–16, 41
See application file for complete search history.

(56) References Cited

U.S. PATENT DOCUMENTS 6,189,993 B1 * 2/2001 Mantell ..... 247/15
6,364,452 B1 * 4/2002 Noyes et al. ..... 347/43
2002/0024558 A1 * 2/2002 Fujita et al. ..... 347/43
2002/0064603 A1 * 5/2002 Noguchi ..... 427/466

* cited by examiner

*Primary Examiner*—Manish S. Shah
*Assistant Examiner*—Laura E. Martin
(74) *Attorney, Agent, or Firm*—Frishauf, Holtz, Goodman & Chick, P.C.

(57) ABSTRACT

An inkjet recording device includes: a recording head provided with a nozzle for jetting ink, wherein the inkjet recording device records an image by jetting the ink from the recording head onto a recording medium, while moving the recording head and the recording medium relatively, and the inkjet recording device further comprises, a viewing distance setting unit for setting a parameter corresponding to a distance from which the recording medium after a recording is viewed; a recording mode setting unit for setting a recording mode based on the parameter set by the viewing distance setting unit; and a control device for controlling an operation of a jetting of the ink by the recording head and the relative movement of the recording head and the recording medium so that the recording is performed according to the recording mode set by the recording mode setting unit.

14 Claims, 10 Drawing Sheets

FIG.9

| MEDIUM TYPE | NOISE LEVEL | RECORDING SIZE | A4 | A3 | A2 | A1 | A0 | 62inch | 124inch |
|---|---|---|---|---|---|---|---|---|---|
| | | | 210 × 297 | 297 × 420 | 420 × 594 | 594 × 841 | 841 × 1189 | 1600WIDTH | 3200WIDTH |
| | | VIEWING DISTANCE[mm] | 300 | 500 | 700 | 1000 | 1500 | 3000 | 5000 |
| PAPER OR VINYL CHLORIDE SYSTEM | 1 (HIGH QUALITY) | RESOLUTION[dpi] | 720 × 1440 | 720 × 1440 | 720 × 1440 | 360 × 720 | 360 × 720 | 360 × 720 | 360 × 360 |
| | | THE NUMBER OF PATHS | 16 | 12 | 8 | 6 | 4 | 2 | 1 |
| | | RECORDING DIRECTION | ONE-WAY | TWO-WAY | TWO-WAY | TWO-WAY | TWO-WAY | TWO-WAY | TWO-WAY |
| | 2 (STANDARD) | RESOLUTION[dpi] | 720 × 1440 | 720 × 1440 | 360 × 720 | 360 × 720 | 360 × 720 | 360 × 720 | 360 × 360 |
| | | THE NUMBER OF PATHS | 12 | 8 | 6 | 4 | 2 | 1 | 1 |
| | | RECORDING DIRECTION | TWO-WAY | TWO-WAY | TWO-WAY | TWO-WAY | TWO-WAY | TWO-WAY | TWO-WAY |
| | 3 (HIGH SPEED) | RESOLUTION[dpi] | 720 × 1440 | 360 × 720 | 360 × 720 | 360 × 720 | 360 × 720 | 360 × 720 | 360 × 360 |
| | | THE NUMBER OF PATHS | 8 | 6 | 4 | 2 | 1 | 1 | 1 |
| | | RECORDING DIRECTION | TWO-WAY | TWO-WAY | TWO-WAY | TWO-WAY | TWO-WAY | TWO-WAY | TWO-WAY |
| PET SYSTEM | 1 (HIGH QUALITY) | RESOLUTION[dpi] | 720 × 720 | 720 × 720 | 720 × 720 | 360 × 360 | 360 × 360 | 360 × 360 | 360 × 360 |
| | | THE NUMBER OF PATHS | 8 | 6 | 4 | 3 | 2 | 1 | 1 |
| | | RECORDING DIRECTION | ONE-WAY | TWO-WAY | TWO-WAY | TWO-WAY | TWO-WAY | TWO-WAY | TWO-WAY |
| | 2 (STANDARD) | RESOLUTION[dpi] | 720 × 720 | 720 × 720 | 360 × 360 | 360 × 360 | 360 × 360 | 360 × 360 | 360 × 360 |
| | | THE NUMBER OF PATHS | 6 | 4 | 3 | 2 | 1 | 1 | 1 |
| | | RECORDING DIRECTION | TWO-WAY | TWO-WAY | TWO-WAY | TWO-WAY | TWO-WAY | TWO-WAY | TWO-WAY |
| | 3 (HIGH SPEED) | RESOLUTION[dpi] | 720 × 720 | 360 × 360 | 360 × 360 | 360 × 360 | 360 × 360 | 360 × 360 | 360 × 360 |
| | | THE NUMBER OF PATHS | 4 | 3 | 2 | 1 | 1 | 1 | 1 |
| | | RECORDING DIRECTION | TWO-WAY | TWO-WAY | TWO-WAY | TWO-WAY | TWO-WAY | TWO-WAY | TWO-WAY |

FIG.12

| MEDIUM TYPE | NOISE LEVEL | RECORDING SIZE | A4 | A3 | A2 | A1 | A0 | 62inch | 124inch |
|---|---|---|---|---|---|---|---|---|---|
| | | | 210 × 297 | 297 × 420 | 420 × 594 | 594 × 841 | 841 × 1189 | 1600WIDTH | 3200WIDTH |
| | | VIEWING DISTANCE[mm] | 300 | 500 | 700 | 1000 | 1500 | 3000 | 5000 |
| PAPER OR VINYL CHLORIDE SYSTEM | 1 (HIGH QUALITY) | RESOLUTION[dpi] | 1200 × 2400 | 1200 × 1200 | 1200 × 1200 | 600 × 600 | 600 × 600 | 600 × 600 | 600 × 600 |
| | | CONVEYING SPEED [mm/s] | 75 | 150 | 300 | 300 | 600 | 600 | 600 |
| | 2 (STANDARD) | RESOLUTION[dpi] | 1200 × 1200 | 1200 × 1200 | 600 × 600 | 600 × 600 | 600 × 600 | 600 × 600 | 600 × 600 |
| | | CONVEYING SPEED [mm/s] | 150 | 300 | 300 | 600 | 600 | 600 | 600 |
| | 3 (HIGH SPEED) | RESOLUTION[dpi] | 1200 × 1200 | 600 × 600 | 600 × 600 | 600 × 600 | 600 × 600 | 600 × 600 | 600 × 600 |
| | | CONVEYING SPEED [mm/s] | 300 | 300 | 600 | 600 | 600 | 600 | 600 |
| PET SYSTEM | 1 (HIGH QUALITY) | RESOLUTION[dpi] | 1200 × 1200 | 1200 × 1200 | 600 × 600 | 600 × 600 | 600 × 600 | 600 × 600 | 600 × 300 |
| | | CONVEYING SPEED [mm/s] | 150 | 300 | 300 | 600 | 600 | 600 | 1200 |
| | 2 (STANDARD) | RESOLUTION[dpi] | 1200 × 1200 | 600 × 600 | 600 × 600 | 600 × 600 | 600 × 600 | 600 × 300 | 600 × 300 |
| | | CONVEYING SPEED [mm/s] | 300 | 300 | 600 | 600 | 600 | 1200 | 1200 |
| | 3 (HIGH SPEED) | RESOLUTION[dpi] | 600 × 600 | 600 × 600 | 600 × 600 | 600 × 600 | 600 × 300 | 600 × 300 | 600 × 300 |
| | | CONVEYING SPEED [mm/s] | 300 | 600 | 600 | 600 | 1200 | 1200 | 1200 |

INKJET RECORDING DEVICE

BACKGROUND OF THE INVENTION

1. Field of the Invention

The present invention relates to an inkjet recording device, in particular, an inkjet recording device in which photocurable ink is used.

2. Description of Related Art

In these years, an inkjet recording system has been applied to various printing fields of special printing or the like such as photographs, various type of printings, markings, color filters, for the reason that the inkjet recording system can make images more easily and more inexpensively than gravure printing system. In particular, as for the inkjet recording system, an image quality matching silver halide imaging can be obtained by the combination of: an inkjet printer of an inkjet recording system, which controls and jets minute dots; ink of which color reproduction range, endurance, jetting adequacy or the like are improved; and exclusive paper of which ink absorbability, color developing property of color materials, gloss of a surface or the like are dramatically improved.

As the inkjet recording system of these days, a phase change inkjet system where a wax ink which is solid at normal temperature, a solvent series inkjet system where ink mainly containing quick-drying organic solvent, a photocurable inkjet system where photocurable ink cured with the irradiation of the ultraviolet rays, and the like are cited. Among them, the photocurable inkjet system has drawn attention because it has comparatively low odor compared with the other recording systems and allows recording to the recording media which have no quick-drying property and ink absorbability as well as the exclusive paper.

In these inkjet printers used in photocurable inkjet system, generally, an ultraviolet rays source for curing ink is arrayed. When an image is recorded on recording medium, the ink is cured by irradiation of the ultraviolet rays from the UV light source, soon after the landing of the ink onto the recording medium (for example, refer to Jp-Tokukai-2001-310454A).

Jp-Tokukai-2001-310454A teaches an example of recording in the same mode regardless of recording medium. However, in the inkjet recording device where paper medium especially having ink absorbability, films such as OHP having ink absorber layer, and the like are used as recording medium, the ink absorbability has difference according to the recording medium. Therefore, in accordance with the type of the recording medium, the difference of the color density or the color tone which occur on every recording medium are corrected to be almost averaged, by changing the number of scans of a recording head (refer to Japanese Patent No. 2752759), changing a head driving condition such as driving voltage of the recording head or a driving pulse (refer to Japanese Patent No. 2804573), adjusting the amount of the jetting of the ink of each color per one dot (refer to Japanese Patent No. JP-3031938), or adjusting a tone curve.

Incidentally, a demanded image quality level such as high precision (for example, "fine") or a recording speed (for example, "high speed") has been selected by a user so far. Then, according to the selection, a recording mode has been changed. There is a close relationship between the recording quality and the productivity. That is, the higher the recording quality is demanded, the lower the productivity becomes. Further, the higher the productivity is demanded, the lower the recording quality becomes.

Hereupon, the impressions for the image quality of the recording medium after the recording differ according to the difference of a viewing distance from which the recording medium is viewed. Generally, the farther the distance from which the recording medium is viewed is, the lower the importance required for the image quality is. Further, output objects (recording medium) on which the recording are performed have respectively different viewing distances from which the recording medium are viewed according to the sizes of the recording medium. The impressions for the image quality of the recording medium differ according to the difference of the observation distance. Generally, the larger the recording size is, the farther the distances from which the recording medium are viewed tend to be. That is, the larger the recording size is, the lower the importance required for the image quality is. Then the recording speed (productivity) rather than the image quality becomes important.

However, conventionally, when a recording mode has been set according to the selected image quality level, the recording is performed in the recording mode regardless of the viewing distance for the recording medium or the recording size of the recording medium. Therefore, the recording is not always performed with the recording qualities which satisfy the levels demanded for the viewing distances for the recording media. Accordingly, the productivities are sometimes low, because unneeded high recording qualities are set.

SUMMARY OF THE INVENTION

The present invention is in the view of above-mentioned problems. An object of the present invention is to provide inkjet recording device for setting a recording mode primarily in view of a distance from which a recording medium is visually recognized, performing a recording with an intended recording quality based on a viewing distance, and performing a recording having a good balance between the recording quality and productivity.

To accomplish the above object, according to a first aspect of the present invention, an inkjet recording device comprises:

a recording head provided with a nozzle for jetting ink, wherein the inkjet recording device records an image by jetting the ink from the recording head onto a recording medium, while moving the recording head and the recording medium relatively, and the inkjet recording device further comprises, a viewing distance setting unit for setting a parameter corresponding to a distance from which the recording medium after a recording is viewed;

a recording mode setting unit for setting a recording mode based on the parameter set by the viewing distance setting unit; and a control device for controlling an operation of a jetting of the ink by the recording head and the relative movement of the recording head and the recording medium so that the recording is performed according to the recording mode set by the recording mode setting unit.

According to the above inkjet recording device, the parameter corresponding to the viewing distance, from which the recording medium after the recording is viewed, is set in the viewing distance setting unit. As for the method of the setting, a user may input the parameter manually, or select the parameter from a selection group which is, for example, provided by a pull-down menu. In the recording mode setting unit, the recording quality is determined based on the inputted parameter, and the recording mode for satisfying the recording quality is set.

The control device controls the operation of the jetting of the ink by the recording head and the relative movement of the recording head and the recording medium according to the recording mode. By the controlling as above, the recording is performed.

As above, the recording quality (image quality) and the recording speed are controlled by selecting the recording mode based on the visual characteristics as follows, that is, generally, in the case that the recording medium is visually recognized from far, even if the image quality is low, viewers can feel that the recording medium has the same image quality, compared with the case where the image having the higher image quality is viewed up close. Consequently, the recording having a good balance between the actually demanded recording quality and productivity, can be performed.

Preferably, the inkjet recording device, further comprises a head scanning mechanism for making the recording head scan in a direction perpendicular to a conveying direction of the recording medium, wherein the recording mode set by the recording mode setting unit is the number of scans of the recording head which is required to record a predetermined area in the conveying direction of the recording medium.

According to the above inkjet recording device, the recording mode is defined based on the number of scans (paths) of the recording head which is required to record a predetermined area in the conveying direction of the recording medium. The control device controls the image quality and the recording speed by controlling the number of the scans of the recording head so as to increase or decrease the number of the scans according to the number of the scans corresponding to the viewing distance set in the viewing distance setting unit. Consequently, the recording having a good balance between the actually demanded recording quality and productivity, can be performed easily.

Preferably, the inkjet recording device, further comprises a head scanning mechanism for making the recording head scan in a direction perpendicular to a conveying direction of the recording medium, wherein the recording mode set by the recording mode setting unit is any one of a two-way recording for performing the recording by jetting the ink from the recording head in both directions of a back-and-forth scan of the recording head by the head scanning mechanism, or a one-way recording for performing the recording by jetting the ink from the recording head in one direction of a back-and-forth scan of the recording head by the head scanning mechanism.

According to the above inkjet recording device, the recording mode is defined based on whether the recording by the recording head is performed at both scans of the back-and-forth movement on the recording medium, that is, two-way scan recording, or the recording by the recording head is performed at only the back scan or the forth scan, that is, one-way scan recording. By controlling the operation of the jetting of the ink by the recording head so as to set the operation as any one of the two-way recording and the one-way recording according to the recording mode corresponding to the viewing distance set in the viewing distance setting unit, the control device can increase and decrease the number of the scan recording (paths). Then, the control device controls the recording quality and the recoding speed. Consequently, the recording having a good balance between the actually demanded recording quality and productivity, can be performed easily.

Preferably, the inkjet recording device, further comprises a head scanning mechanism for making the recording head scan in a direction perpendicular to a conveying direction of the recording medium, wherein the recording mode set by the recording mode setting unit is a scan speed of the recording head by the head scanning mechanism.

According to the above inkjet recording device, the recording mode is defined based on the scan speed of the recording head on the recording medium. The control device controls the image quality and the recording speed by adjusting the scan speed of the recording head at the recording. Consequently, the recording having a good balance between the actually demanded recording quality and productivity, can be performed easily.

Preferably, the nozzle is formed extending along a recording width of the recording medium, the inkjet recording device further comprises a conveying mechanism for conveying the recording medium in a direction perpendicular to the recording width, and the recording mode set by the recording mode setting unit is a conveying speed of the recording medium by the conveying mechanism.

According to the above inkjet recording device, the parameter corresponding to the viewing distance, from which the recording medium after the recording is viewed, is set in the viewing distance setting unit. As for the method of the setting, a user may input the parameter manually, or select the parameter from a selection group which is, for example, provided by a pull-down menu. In the recording mode setting unit, the recording quality is determined based on the inputted parameter, and the recording mode for satisfying the recording quality is set. The recording mode is defined based on the conveying speed of the recording medium by the conveying mechanism. The control device controls the operation of the recording head of the line type and the operation of the conveying mechanism for the recording medium according to the recording mode. By the controlling as above, the recording is performed.

As above, the recording quality (image quality) and the recording speed are controlled by selecting the recording mode based on the visual characteristics as follows, that is, generally, in the case that the recording medium is visually recognized from far, even if the image quality is low, viewers can feel that the recording medium has the same image quality, compared with the case where the image having the higher image quality is viewed up close. Consequently, the recording having a good balance between the actually demanded recording quality and productivity, can be performed.

Preferably, the recording mode set by the recording mode setting unit is a recording resolution.

According to the above inkjet recording device the recording mode is defined based on the recording resolution. The control device controls the recording quality and the recording speed by adjusting the scan speed of the recording head according to the recording mode in the case that the serial type head is used for the recording, and by adjusting the conveying speed of the recording medium according to the recording mode in the case that the line type head is used for the recording. Consequently, the recording having a good balance between the actually demanded recording quality and productivity, can be performed.

Preferably, the inkjet recording device, further comprises an image quality level setting unit for setting an intended image quality level of the image to be recorded, wherein the recording mode setting unit sets the recording mode based on the parameter set by the viewing distance setting unit and the image quality level set by the image quality level setting unit.

According to the above inkjet recording device, the image quality level of the image to be recorded, which is intended by a user, such as "HIGH QUALITY" or "HIGH SPEED", is set in the image quality setting unit. In the recording mode setting unit, the recording quality is determined also in view of the inputted image quality level, and accordingly, the recoding mode satisfying the recording quality is set. Not only the viewing distance but also the image quality level can be set, that is, the recording mode can be set according to the intended image quality level even when the viewing distances are the same. Consequently, the recording can be performed in the condition closer to that of the actually demanded recording quality and productivity.

Preferably, the inkjet recording device, further comprises a recording medium specifying unit for specifying a type of the recording medium, wherein the recording mode setting unit sets the recording mode based on the parameter set by the viewing distance setting unit and the type of the recording medium specified by the recording medium specifying unit.

According to the above inkjet recording device, the type of the recording medium such as material, surface condition, transparency, gloss, fluorescence intensity characteristic are specified in the recoding medium specifying unit. In the recording mode setting unit, the recording mode is set also in view of the type of the recording medium. Even if the image quality levels are the same when the same viewing distances and the image quality levels are set, the recording mode can be changed also according to the difference of the type of the recording medium, for example, the difference whether the ink permeability of the recording medium is high or low, or whether the dot diameter of the ink tend to be extended or not on the recording medium. Consequently, the recording having a good balance between the actually demanded recording quality and productivity, can be performed.

Preferably, the inkjet recording device, further comprises an interface for connecting with an external device, wherein an input for the setting in the viewing distance setting unit is performed in a computer system connected to the interface directly or through a predetermined network.

According to the above inkjet recording device, the input for the setting of the parameter corresponding to the viewing distance can be performed from the external computer system. Consequently, the recording mode can be defined from a remote place.

Preferably, the inkjet recording device, further comprises an interface for connecting with an external device, wherein an input for the setting in the image quality level setting unit is performed in a computer system connected to the interface directly or through a predetermined network.

According to the above inkjet recording device, the input for the setting of the image quality level can be performed from the external computer system. Consequently, the recording mode can be defined from a remote place.

Preferably, the inkjet recording device, further comprises an interface for connecting with an external device, wherein an input for the setting in the recording medium specifying unit is performed in a computer system connected to the interface directly or through a predetermined network.

According to the above inkjet recording device, the input for the specifying of the recording medium can be performed from the external computer system. Consequently, the recording mode can be defined from a remote place.

Preferably, the ink is photocurable ink cured by irradiation of a light, and the inkjet recording device further comprises a light source for irradiating the light onto the photocurable ink jetted from the recording head and landed on the recording medium.

According to the above inkjet recording device, even if the recording medium of the material having no ink absorbability, the same effect as described above can be obtained.

Preferably, the photocurable ink is UV curable ink cured by irradiation of a ultraviolet ray, and the light source is an UV light source for generating the ultraviolet ray.

According to the above inkjet recording device, by using the ultraviolet rays having higher energy, the above effect can be obtained more efficiently.

Preferably, the UV curable ink is ink comprising a cationic polymerizable compound.

According to the above inkjet recording device, by using the cationic polymerizable compound having high reactivity, the curing reaction is progressed faster. Then, the above effect can be obtained more efficiently.

According to a second aspect of the present invention, an inkjet recording device comprises:

a recording head provided with a nozzle for jetting ink, wherein the inkjet recording device records an image by jetting the ink from the recording head onto a recording medium, while moving the recording head and the recording medium relatively, and the inkjet recording device further comprises, an image quality level setting unit for setting an intended image quality level of the image to be recorded;

a size identifying unit for identifying a recording size of the image to be recorded;

a recording mode setting unit for setting a recording mode based on the image quality level set by the image quality level setting unit and the recording size identified by the size identifying unit; and a control device for controlling an operation of a jetting of the ink by the recording head and the relative movement of the recording head and the recording medium so that the recording is performed according to the recording mode set by the recording mode setting unit.

According to the inkjet recording device, the image quality level which is intended by a user is set in the image quality level setting unit. On the other hand, the size of the image which is actually recorded, that is, the size of the image which is actually viewed (recording size), is identified in the size identifying unit.

As the recording size, the actual size of the image to be recorded can be specified based on the length of the diagonal line of the image when the image is considered as approximate quadrangular shape. It is known that the length of the diagonal line is equal to the viewing distance from which human actually view the image.

In the recording mode setting unit, the recording quality is determined based on the inputted image level and the identified recording size. Accordingly, the recording mode satisfying the recording quality is set. The recording mode is determined based on not only the image quality level inputted by a user, but also consideration of the recording size.

The control device controls the operation of the jetting of the ink by the recording head and the relative movement of the recording head and the recording medium according to the recording mode. By the controlling as above, the recording is performed.

As above, the recording mode is determined based on not only the image quality level inputted by a user, but also the consideration of the recording size. By performing the recording based on the recording mode, the recording having a good balance between the actually demanded recording quality and productivity, can be performed.

Preferably, the inkjet recording device, further comprises a head scanning mechanism for making the recording head scan in a direction perpendicular to a conveying direction of the recording medium, wherein the recording mode set by the recording mode setting unit is the number of scans of the recording head which is required to record a predetermined area in the conveying direction of the recording medium.

According to the above inkjet recording device, the recording mode is defined based on the number of the scans (paths) on the recording medium, which is performed by the recording head of the serial type every conveyance of the recording medium in the conveying direction by one scan. The control device controls the recording quality and the recoding speed by controlling the number of the scans of the recording head so as to increase or decrease the number of the scans according to the number of the scans corresponding to the image quality level or the recording size. Consequently, the recording having a good balance between the actually demanded recording quality and productivity, can be performed.

Preferably, the inkjet recording device, further comprises a head scanning mechanism for making the recording head scan in a direction perpendicular to a conveying direction of the recording medium, wherein the recording mode set by the recording mode setting unit is any one of a two-way recording for performing the recording by jetting the ink from the recording head in both directions of a back-and-forth scan of the recording head by the head scanning mechanism, or a one-way recording for performing the recording by jetting the ink from the recording head in one direction of a back-and-forth scan of the recording head by the head scanning mechanism.

According to the above inkjet recording device, the recording mode is defined based on whether the recording by the recording head is performed at both scans of the back-and-forth movement on the recording medium, or only at the back scan or the forth scan. By controlling the operation of the jetting of the ink by the recording head so as to set the operation as any one of the two-way recording and the one-way recording according to the recording mode corresponding to the image quality level and the recording size, the control device can increase and decrease the number of the scan recording (paths). Then, the control device controls the recording quality and the recoding speed. Consequently, the recording having a good balance between the actually demanded recording quality and productivity, can be performed easily.

Preferably, the inkjet recording device, further comprises a head scanning mechanism for making the recording head scan in a direction perpendicular to a conveying direction of the recording medium, wherein the recording mode set by the recording mode setting unit is a scan speed of the recording head by the head scanning mechanism.

According to the above inkjet recording device, the recording mode is defined based on the scan speed of the recording head on the recording medium. The control device controls the image quality and the recording speed by adjusting the scan speed of the recording head at the recording. Consequently, the recording having a good balance between the actually demanded recording quality and productivity, can be performed easily.

Preferably, the nozzle is formed extending along a recording width of the recording medium, the inkjet recording device further comprises a conveying mechanism for conveying the recording medium in a direction perpendicular to the recording width, and the recording mode set by the recording mode setting unit is a conveying speed of the recording medium by the conveying mechanism.

According to the inkjet recording device, the image quality level which is intended by a user is set in the image quality level setting unit. On the other hand, the size of the image which is actually recorded, that is, the size of the image which is actually viewed (recording size), is identified in the size identifying unit.

As the recording size, the actual size of the image to be recorded can be specified based on the length of the diagonal line of the image when the image is considered as approximate quadrangular shape. It is known that the length of the diagonal line is equal to the viewing distance from which human actually view the image.

In the recording mode setting unit, the recording quality is determined based on the inputted image level and the identified recording size. Accordingly, the recording mode satisfying the recording quality is set. The recording mode is determined based on not only the image quality level inputted by a user, but also the conveying speed of the recording medium by the conveying mechanism with the consideration of the recording size.

The control device controls the operation of the recording head of the line type and the operation of the conveying mechanism for the recording medium according to the recording mode. By the controlling as above, the recording is performed.

As above, the recording mode is determined based on not only the image quality level inputted by a user, but also the consideration of the recording size. By performing the recording based on the recording mode, the recording having a good balance between the actually demanded recording quality and productivity, can be performed.

Preferably, the recording mode set by the recording mode setting unit is a recording resolution.

According to the above inkjet recording device the recording mode is defined based on the recording resolution. The control device controls the recording quality and the recording speed by adjusting the scan speed of the recording head according to the recording mode in the case that the serial type head is used for the recording, and by adjusting the conveying speed of the recording medium according to the recording mode in the case that the line type head is used for the recording. Consequently, the recording having a good balance between the actually demanded recording quality and productivity, can be performed.

Preferably, the inkjet recording device, further comprises a recording medium specifying unit for specifying a type of the recording medium, wherein the recording mode setting unit sets the recording mode based on the type of the recording medium specified by the recording medium specifying unit, the image quality level set by the image quality level setting unit, and the recording size identified by the size identifying unit.

According to the above inkjet recording device, the type of the recording medium such as material, surface condition, transparency, gloss, fluorescence intensity characteristic are specified in the recoding medium specifying unit. In the recording mode setting unit, the recording mode is set according to the type of the recording medium. Even if the image quality levels and the recording sizes are respectively the same, the recording mode can be changed also according to the difference of the type of the recording medium, for example, the difference whether the ink permeability of the recording medium is high or low, or whether or not the dot diameter of the ink tend to be extended on the recording medium. Consequently, the recording having a good balance between the actually demanded recording quality and productivity, can be performed.

Preferably, the inkjet recording device, further comprises an interface for connecting with an external device, wherein an input for the setting in the viewing distance setting unit is performed in a computer system connected to the interface directly or through a predetermined network.

According to the above inkjet recording device, the input for the setting of the image quality level can be performed from the external computer system. Consequently, the recording mode can be defined from a remote place.

Preferably, the inkjet recording device, further comprises an interface for connecting with an external device, wherein an input for the setting in the viewing distance setting unit is performed in a computer system connected to the interface directly or through a predetermined network.

According to the above inkjet recording device, the input for the specifying of the recording medium can be performed from the external computer system. Consequently, the recording mode can be defined from a remote place.

Preferably, the ink is photocurable ink cured by irradiation of a light, and the inkjet recording device further comprises a light source for irradiating the light onto the photocurable ink jetted from the recording head and landed on the recording medium.

According to the above inkjet recording device, even if the recording medium of the material having no ink absorbability, the same effect as described above can be obtained.

Preferably, the photocurable ink is UV curable ink cured by irradiation of a ultraviolet ray, and the light source is an UV light source for generating the ultraviolet ray.

According to the above inkjet recording device, by using the ultraviolet rays having higher energy, the above effect can be obtained more efficiently.

Preferably, the UV curable ink is ink comprising a cationic polymerizable compound.

According to the above inkjet recording device, by using the cationic polymerizable compound having high reactivity, the curing reaction is progressed faster. Then, the above effect can be obtained more efficiently.

BRIEF DESCRIPTION OF THE DRAWINGS

The present invention will become more fully understood from the detailed description given hereinafter and the accompanying drawing given by way of illustration only, and thus are not intended as a definition of the limits of the present invention, and wherein:

FIG. 9 is a diagram describing a recording mode set in the fourth embodiment;

FIG. 12 is a diagram describing a recording mode set in the sixth embodiment.

PREFERRED EMBODIMENTS OF THE INVENTION

Hereinafter, the embodiments of the present invention will be explained referring to FIG. 1 to FIG. 12.

Figure 1:
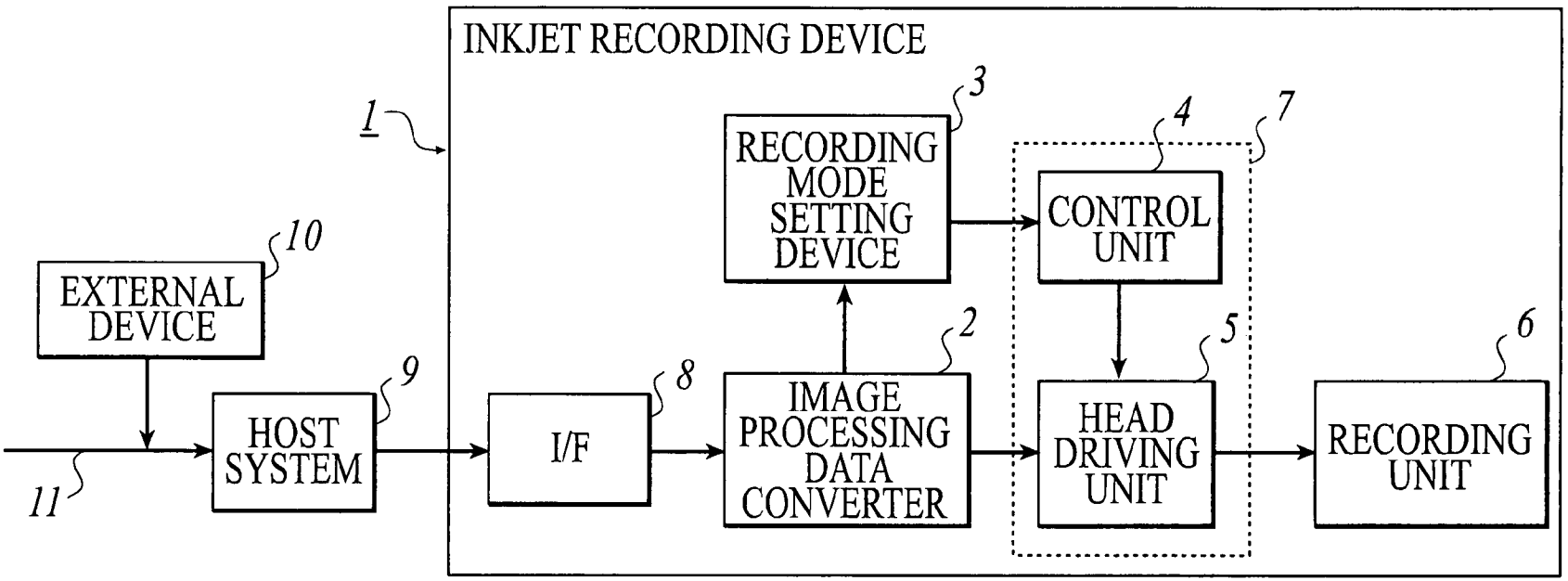
FIG. 1 is a block diagram showing a substantial part of a first embodiment of an inkjet recording device related to the present invention.

FIG. 1 shows a first embodiment of an inkjet recording device related to the present invention. The inkjet recording device 1 comprises a recording unit 7 comprising a recording heads for jetting ink of a plurality of colors onto a recording medium, and a conveying mechanism, which is not shown, for conveying the recording medium from a feeding unit to the recording heads, further to an exit port.

For example, an encoding including a normal compression processing is performed to an image data sent from a host system 9 though an interface (I/F) 8. Therefore, in the inkjet recording device 1 in FIG. 1, an image processing data converter 2 decodes the inputted image data so as to change the inputted image data into the data of which data format can be processed in the inkjet recording device 1, and sends the data obtained by the decoding to a recording mode setting device 3 and a head driving unit 5, respectively.

The recording mode setting device 3 sets a recording mode for performing the recording onto the recording medium, and sends the set recording mode to a control device 7.

Figure 2:
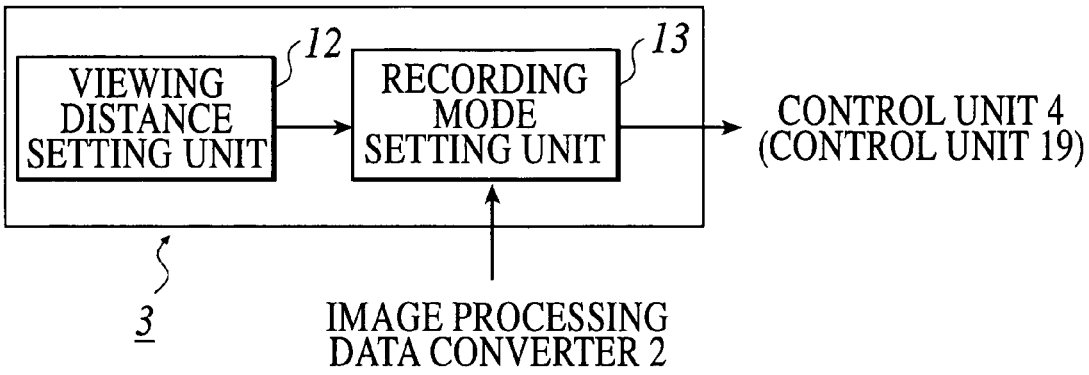
FIG. 2 is a block diagram showing an example of a substantial part of a recording mode setting device 3.

FIG. 2 is a block diagram showing an example of the concrete configuration of the recording mode setting device 3. The recording mode setting device 3 comprises a viewing distance setting unit 12 for setting a parameter corresponding to the viewing distance for the recording medium, and a recording mode setting unit 13 for setting the recording mode.

The viewing distance setting unit 12 sets a distance from which the recording medium after the recording is visually recognized by a user, and sends the set data to the recording mode setting unit 13. On this occasion, the distance may be input directly, or selected from a group provided in stages by pull-down menus or the like. The input viewing distance or the data corresponding to the viewing distance (the data is called "parameter") is sent to the recording mode setting unit 13.

The recording mode setting unit 13 sets the recording mode for the recording onto the recording medium, based on the parameter which is set in the viewing distance setting unit 12, and sends the recording mode to a control unit 4. Incidentally, this recording mode is set based on the parameters such as a resolution, the number of scans (the number of paths) of the recording head, a recording (jetting) direction (that is, the one-way recording or the two-way recording), a scan speed, an amount of the jetting of the ink.

Figure 3:
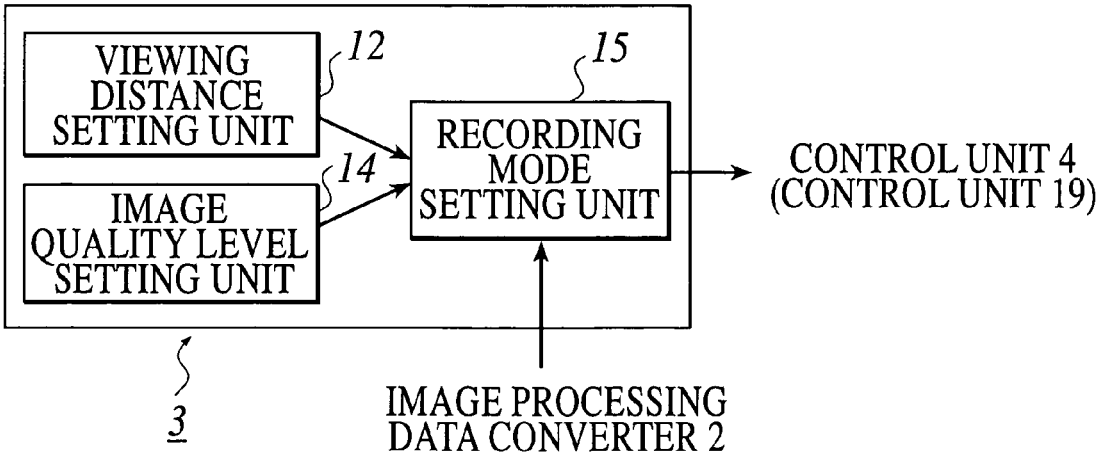
FIG. 3 is a block diagram showing another example of a substantial part of a recording mode setting device 3.

Further, FIG. 3 is a block diagram showing another example of the concrete configuration of the recording mode setting device 3. The recording mode setting device 3 comprises the viewing distance setting unit 12, an image quality level setting unit 14 for setting an image quality, and a recording mode setting unit 15 for setting a recording mode. In FIG. 3, the viewing distance setting unit 12 has the same configuration as that shown in FIG. 2.

The image quality level setting unit 14 specifies an image quality level intended by a user, and sends the image quality level to the recording mode setting unit 15. The image quality level may be specified by selecting it, for example, from image quality levels provided beforehand as pull-down menus in three stages or the like, or may be specified by inputting it directly.

The recording mode setting unit 15 sets the recording mode for the recording onto the recording medium, based on the parameter which is set in the viewing distance setting unit 12 and the image quality level which is specified in the image quality level setting unit 14, and sends the recording mode to a control unit 4. Incidentally, this recording mode is set based on the parameters such as a resolution, the number of scans (the number of paths) of the recording head, a recording (jetting) direction (that is, the one-way recording or the two-way recording), a scan speed, an amount of the jetting of the ink, as described above.

Figure 4:
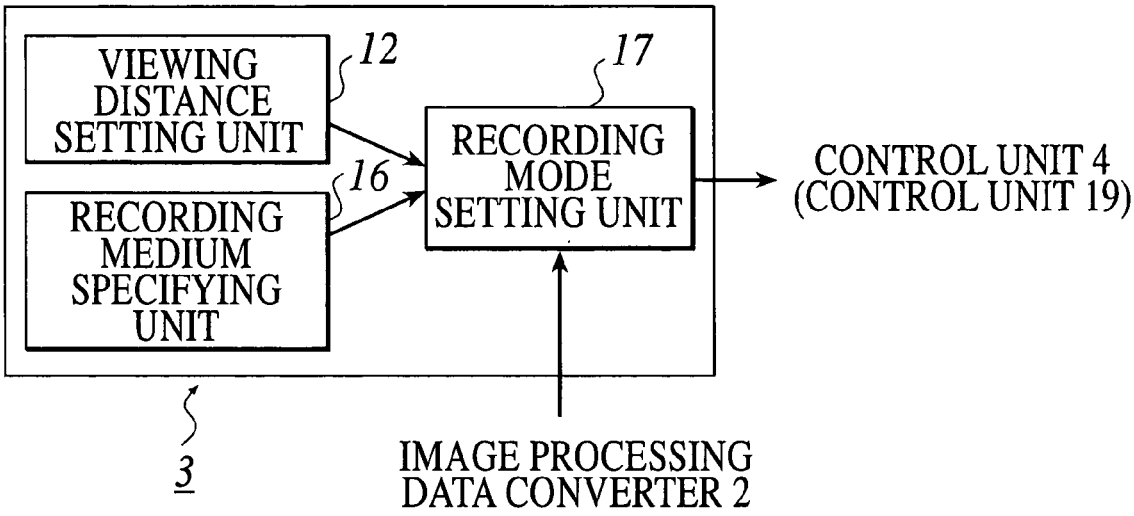
FIG. 4 is a block diagram showing another example of a substantial part of a recording mode setting device 3.

Further, FIG. 4 is a block diagram showing another example of the concrete configuration of the recording mode setting device 3. The recording mode setting device 3 comprises the viewing distance setting unit 12, a recording medium specifying unit 16 for specifying the type of a recording medium, and a recording mode setting unit 17 for setting a recording mode. In FIG. 4, the viewing distance setting unit 12 has the same configuration as that shown in FIG. 2.

The recording medium specifying unit 16 specifies the type of a recording medium, and sends the specified result to the recording mode setting unit 17. The type of a recording medium is specified from the concrete name of the substance or various properties such as material, surface condition, transparency, gloss, fluorescence intensity characteristic. The concrete method for the specifying is described in, for example, JP-Tokukai-2002-167082A.

The recording mode setting unit 17 sets the recording mode for the recording onto the recording medium, based on the parameter which is set in the viewing distance setting unit 12 and the type of the recording medium which is specified in the recording medium specifying unit 16, and sends the recording mode to the control unit 4. Incidentally, this recording mode is set based on the parameters-such as a resolution, the number of scans (the number of paths) of the recording head, a recording (jetting) direction (that is, the one-way recording or the two-way recording), a scan speed, an amount of the jetting of the ink, as described above.

Figure 5:
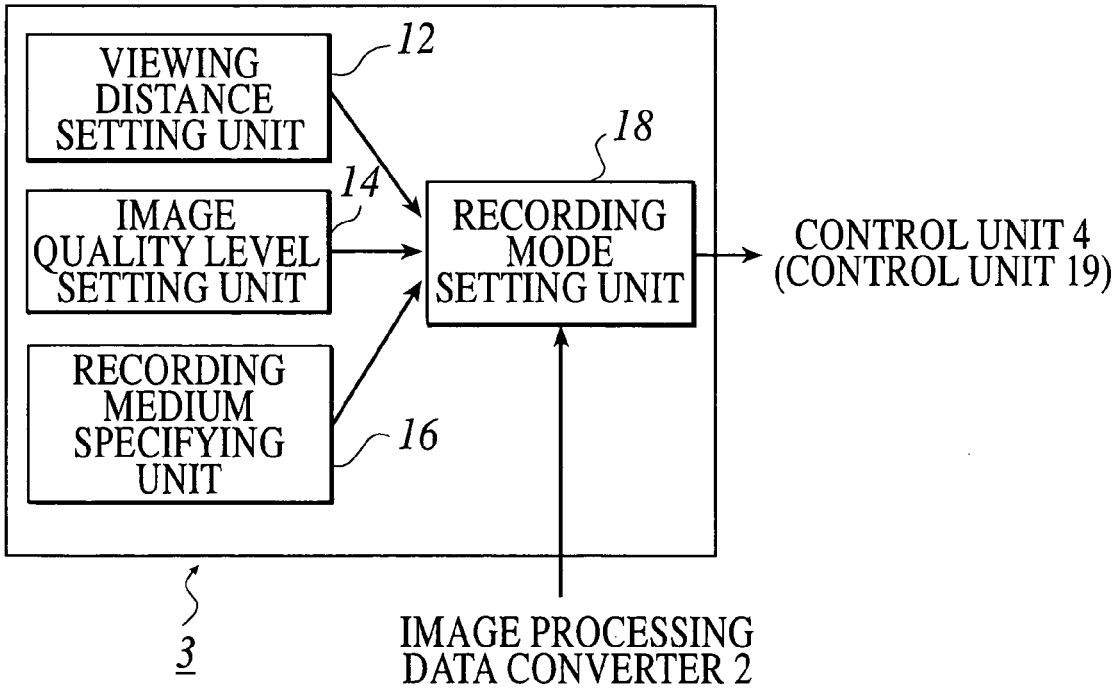
FIG. 5 is a block diagram showing another example of a substantial part of a recording mode setting device 3.

Further, FIG. 5 is a block diagram showing another example of the concrete configuration of the recording mode setting device 3. The recording mode setting device 3 comprises the viewing distance setting unit 12, the image quality level setting unit 14, the recording medium specifying unit 16, and a recording mode setting unit 18 for setting a recording mode. In FIG. 5, the viewing distance setting unit 12 has the same configuration as that shown in FIG. 2, the image quality level setting unit 14 has the same configuration as that shown in FIG. 3, and the recording medium specifying unit 16 has the same configuration as that shown in FIG. 4.

The recording mode setting unit 18 sets the recording mode for the recording onto the recording medium, based on the parameter which is set in the viewing distance setting unit 12, the image quality level which is set in the image quality setting unit 14, and the type of the recording medium which is specified in the recording medium specifying unit 16. Then, The recording mode setting unit 18 sends the recording mode to the control unit 4. Incidentally, this recording mode is set based on the parameters such as a resolution, the number of scans (the number of paths) of the recording head, a recording (jetting) direction (that is, the one-way recording or the two-way recording), a scan speed, an amount of the jetting of the ink, as described above.

In FIG. 1, a control device 7 is a device for controlling the operation of a recording unit 6 so that the recording can be performed in the recording mode set as described above. The control device 7 comprises the head driving unit 5 for driving the recording unit 6, and the control unit 4 for sending instructions to the head driving unit 5 based on the recording mode.

The control unit 4 comprises, for example, a CPU, a ROM and a RAM (not shown). The control unit 4 develops a processing program, which is recorded in the ROM, to the RAM, and accordingly, makes the CPU execute the processing program. The control unit 4 sends a signal, which instructs the recording unit 6 to operate according to the recording mode set by the recording mode setting device 3, to the head driving unit 5. Further, the head driving unit 5 drives the recording unit 6 so that the data related to the image to be recorded which is obtained in the image processing data converter 2 can be recorded according to the signal sent from the control unit 4.

The recording unit 6 comprises an inkjet type recording head, and a head scanning mechanism for making the recording head scan in a direction perpendicular to a conveying direction of the recording medium.

The recording head is so-called serial type head, and comprises a plurality of nozzles for jetting ink. In the case that the ink of a plurality of colors are used, the recording heads are provided respectively with respect to each of colors, and each of the ink respectively having different colors is jetted from each of the recording heads.

As the ink charged in the recording head, cationic polymerization system ink having high reactivity for the UV curable property is preferably used. Further, in the case that the UV curable ink is used, preferably, an UV light source is preferably used so as to cure the ink jetted onto the recording medium by irradiation of the ultraviolet rays to the ink. Further, as the light source, a cold cathode fluorescent tube, a hot cathode fluorescent tube, a low pressure mercury lamp or the like, which irradiates ultraviolet rays, can be cited. In the case that the UV curable ink and the UV light source are used, as the recording medium, the recording medium having no ink absorbability, that is, having no ink absorber layer, can be used.

Although not shown, the head scanning mechanism comprises a carriage on which the recording head and if necessary UV light source is mounted, a guide for making the carriage scan in the direction perpendicular to the conveying direction of the recording medium, and the like.

The host system 9 is connected to the inkjet recording device 1 through the interface 8. Furthermore, an external device 10 is connected to the host system 9 through a network 11. The host system 9 and the external device 10 send the image data for the recording to the inkjet recording device 1, and additionally, perform the input for the control of the operation of the whole inkjet recording device 1. Further, the host system 9 and the external device 10 can perform the input for the setting in the viewing distance setting unit 12, the image quality level setting unit 14 and/or the recording medium specifying unit 16.

Next, an operation in the present invention will be described.

The input image data sent to the inkjet recording device 1 is decoded as predetermined, converted into a pixel value and so on, in the image processing data converter 2. The obtained data is sent to the recording mode setting device 3 and the head driving unit 5.

When the recording mode setting device 3 is configured as shown in FIG. 2, the parameter corresponding to the viewing distance for the recording medium is set in the viewing distance setting unit 12. Further, in the recording mode setting unit 13, the recording mode is set based on the parameter set in the viewing distance setting unit 12. Then, the recording mode is sent to the control unit 4. The following Table 1 shows one of the examples of the relationship between the viewing distance parameter and the recording mode. Incidentally, although not show, the input for the setting of the distance can be also performed in the host system 9 or the external device 10.

decreased. Further, by decreasing the resolution and the number of the paths as described above, the recording speed can be increased.

Therefore, although the recording mode where the viewing distance parameter is "0–349 mm" has been described above, in the case that the viewing distance is increased, as shown in Table 1, the resolution and the number of paths is decreased, the two-way direction jetting is performed, further, although not shown, the scan speed of the recording head and the amount of the jetting of the ink is increased, as needed. Consequently, the image quality level which is nearly equal to the image qualities for other viewing distances can be acquired.

Further, when the recording mode setting device 3 is configured as shown in FIG. 3, the parameter corresponding to the viewing distance for the recording medium is set in the viewing distance setting unit 12. Further, in the image quality level setting unit 14, the intended image quality level is set. Incidentally, although not shown, the input for the setting of the distance and the input for the setting of the image quality level can be also performed in the host system 9 or the external device 10.

Hereupon, in the image quality level setting unit 14, the parameter corresponding to the image quality level, that is, so-called noise level, which is intended by a user, is inputted. The term "noise" cited here is defined as the standard deviation of the brightness and the chromaticity in the uniform color space on the basis of the human perceptual model, as shown in "The Journal of the Society of Photographic Science and Technology of Japan, Vol. 57, No. 6 (1994), Pages 392 to 398". The image quality level set here corresponds to the noise level which is configured by grouping the degrees of the noise. Concretely, the levels are represented as each of levels such as "HIGH QUALITY", "STANDARD", "HIGH SPEED". Incidentally, when the

TABLE 1

| | VIEWING DISTANCE(mm) | | | | | | |
|---|---|---|---|---|---|---|---|
| | 0–349 | 350–649 | 650–999 | 1000–1399 | 1400–2199 | 2200–3799 | 3800- |
| RESOLUTION(dpi) | 720 × 1440 | 720 × 1440 | 720 × 1440 | 360 × 720 | 360 × 720 | 360 × 720 | 360 × 360 |
| THE NUMBER OF PATHS | 16 | 12 | 8 | 6 | 4 | 2 | 1 |
| JETTING DIRECTION | ONE-WAY | TWO-WAY | TWO-WAY | TWO-WAY | TWO-WAY | TWO-WAY | TWO-WAY |

According to Table 1, for example, when the viewing distance parameter is set as "0–349 mm", the recording mode where the resolution is "720×1440 dpi", the number of paths is "16" and the jetting direction is "ONE-WAY" is selected and set. Further, although not shown, other parameters such as the scan speed of the recording head or the amount of the jetting of the ink may be set in addition to above parameters.

Table 1 shows a group of the recording mode which provides the image qualities, which are recognized by human eyes that the image qualities are nearly equal each other, with respect to the various viewing distances. That is, as the viewing distance is increased, the resolution can be decreased, and then, the number of the paths can be "HIGH QUALITY" level is selected, the high quality instead of the low recording speed can be achieved. In addition, when the "HIGH SPEED" level is selected, the amount of the time required for the recording can be decreased, although the recording quality (image quality) is lower.

In the recording mode setting unit 15, the recording mode is set based on the parameter which is set in the viewing distance setting unit 12 and the image quality level which is set in the image quality level setting unit 14. Then, the recording mode is sent to the control unit 4. The following Table 2 shows one of the examples of the relationship between the viewing distance parameter and the image quality level, and the recording mode.

TABLE 2

| IMAGE QUALITY LEVEL | | VIEWING DISTANCE(mm) 0–349 | 350–649 | 650–999 | 1000–1399 | 1400–2199 | 2200–3799 | 3800- |
|---|---|---|---|---|---|---|---|---|
| 1 (HIGH QUALITY) | RESOLUTION(dpi) | 720 × 1440 | 720 × 1440 | 720 × 1440 | 360 × 720 | 360 × 720 | 360 × 720 | 360 × 360 |
| | THE NUMBER OF PATHS | 16 | 12 | 8 | 6 | 4 | 2 | 1 |
| | JETTING DIRECTION | ONE-WAY | TWO-WAY | TWO-WAY | TWO-WAY | TWO-WAY | TWO-WAY | TWO-WAY |
| 2 (STANDARD) | RESOLUTION(dpi) | 720 × 1440 | 720 × 1440 | 360 × 720 | 360 × 720 | 360 × 720 | 360 × 720 | 360 × 360 |
| | THE NUMBER OF PATHS | 12 | 8 | 6 | 4 | 2 | 1 | 1 |
| | JETTING DIRECTION | TWO-WAY | TWO-WAY | TWO-WAY | TWO-WAY | TWO-WAY | TWO-WAY | TWO-WAY |
| 3 (HIGH SPEED) | RESOLUTION(dpi) | 720 × 1440 | 360 × 720 | 360 × 720 | 360 × 720 | 360 × 720 | 360 × 720 | 360 × 360 |
| | THE NUMBER OF PATHS | 8 | 6 | 4 | 2 | 1 | 1 | 1 |
| | JETTING DIRECTION | TWO-WAY | TWO-WAY | TWO-WAY | TWO-WAY | TWO-WAY | TWO-WAY | TWO-WAY |

According to Table 2, for example, when the viewing distance parameter is set as "0–349 mm" and the image quality level is set as "LEVEL 1 (HIGH QUALITY)", the recording mode where the resolution is "720×1440 dpi", the number of paths is "16" and the jetting direction is "ONE-WAY" is selected and set. Further, although not shown, other parameters such as the scan speed of the recording head or the amount of the jetting of the ink may be set in addition to above parameters.

Table 2 shows a group of the recording mode which provides the image qualities, which are recognized by human eyes that the image qualities are nearly equal each other, with respect to the various viewing distances, in every image quality. That is, even if the image quality levels are the same, as the viewing distance is increased, the resolution can be decreased, and then, the number of paths can be decreased. Further, by decreasing the resolution and the number of the paths as described above, the recording speed can be increased.

Further, when the recording mode setting device 3 is configured as shown in FIG. 4, the parameter corresponding to the viewing distance for the recording medium is set in the viewing distance setting unit 12. Further, in the recording medium specifying unit 16, the type of the recording medium on which the recording will be performed is specified. Incidentally, although not shown, the input for the setting of the distance and the input for the specifying of the type of the recording medium can be also performed in the host system 9 or the external device 10.

In the recording mode setting unit 17, the recording mode is set based on the parameter which is set in the viewing distance setting unit 12 and the type of the recording medium which is specified in the recording medium specifying unit 16. Then, the recording mode is sent to the control unit 4. The following Table 3 shows one of the examples of the relationship between the viewing distance parameter and the type of the recording medium, and the recording mode.

TABLE 3

| TYPE OF RECORDING MEDIUM | | VIEWING DISTANCE(mm) 0–349 | 350–649 | 650–999 | 1000–1399 | 1400–2199 | 2200–3799 | 3800- |
|---|---|---|---|---|---|---|---|---|
| PAPER OR VINYL CHLORIDE SYSTEM | RESOLUTION(dpi) | 720 × 1440 | 720 × 1440 | 720 × 1440 | 360 × 720 | 360 × 720 | 360 × 720 | 360 × 360 |
| | THE NUMBER OF PATHS | 16 | 12 | 8 | 6 | 4 | 2 | 1 |
| | JETTING DIRECTION | ONE-WAY | TWO-WAY | TWO-WAY | TWO-WAY | TWO-WAY | TWO-WAY | TWO-WAY |
| PET SYSTEM | RESOLUTION(dpi) | 720 × 720 | 720 × 720 | 720 × 720 | 360 × 360 | 360 × 360 | 360 × 360 | 360 × 360 |
| | THE NUMBER OF PATHS | 8 | 6 | 4 | 3 | 2 | 1 | 1 |
| | JETTING DIRECTION | ONE-WAY | TWO-WAY | TWO-WAY | TWO-WAY | TWO-WAY | TWO-WAY | TWO-WAY |

Therefore, although the recording mode where the viewing distance parameter is "0–349 mm" has been described above, in the case that the viewing distance is increased, as shown in Table 2, the resolution and the number of paths is decreased, the two-way direction jetting is performed, further, although not shown, the scan speed of the recording head and the amount of the jetting of the ink is increased, as needed. Consequently, the image quality level which is nearly equal to the image qualities for other viewing distances can be acquired. On the other hand, although the recording mode where the image quality level is "LEVEL 1 (HIGH QUALITY)" has been described, in the case that the image quality level is lower, as also shown in Table 2, the resolution and the number of the paths is decreased, the two-way direction jetting is performed, further, although not shown, the scan speed of the recording head and the amount of the jetting of the ink is increased, as needed.

According to Table 3, for example, when the viewing distance parameter is set as "0–349 mm", and the type of the recording medium is set as "PAPER OR VINYL CHLORIDE SYSTEM", the recording mode where the resolution is "720×1440 dpi", the number of paths is "16" and the jetting direction is "ONE-WAY" is selected and set. Further, although not shown, other parameters such as the scan speed of the recording head or the amount of the jetting of the ink may be set in addition to above parameters.

Table 3 shows a group of the recording mode which provides the image qualities, which are recognized by human eyes that the image qualities are nearly equal each other, with respect to the various viewing distances, in every type of different recording medium. That is, even if the types of the recording medium are the same, as the viewing distance is increased, the resolution can be decreased, and then, the number of paths can be decreased. Further, by decreasing the resolution and the number of the paths as described above, the recording speed can be increased.

Therefore, although the recording mode where the viewing distance parameter is "0–349 mm" has been described above, in the case that the viewing distance is increased, as shown in Table 3, the resolution and the number of paths is decreased, the two-way direction jetting is performed, further, although not shown, the scan speed of the recording head and the amount of the jetting of the ink is increased, as needed. Consequently, the image quality level which is nearly equal to the image qualities for other viewing distances can be acquired. On the other hand, although the recording mode where the recording medium is "PAPER OR VINYL CHLORIDE SYSTEM" having low surface energy with respect to the ink has been described, in the case that the recording medium is the one having higher surface energy such as a PET (polyethylene terephthalate), as also shown in Table 3, the resolution and the number of the paths is decreased, the two-way direction jetting is performed, further, although not shown, the scan speed of the recording head and the amount of the jetting of the ink is increased, as needed.

Further, when the recording mode setting device 3 is configured as shown in FIG. 5, the parameter corresponding to the viewing distance for the recording medium is set in the viewing distance setting unit 12. Further, in the image quality level setting unit 14, the image quality level setting is set, and in the recording medium specifying unit 16, the type of the recording medium on which the recording will be performed is specified. Incidentally, although not shown, the input for the setting of the distance, the input for the setting of the image quality level, and the input for the specifying of the type of the recording medium can be also performed in the host system 9 or the external device 10.

In the recording mode setting unit 18, the recording mode is set based on the parameter which is set in the viewing distance setting unit 12, the image quality level which is set in the image quality level setting unit 14 and the type of the recording medium which is specified in the recording medium specifying unit 16. Then, the recording mode is sent to the control unit 4. The following Table 4 shows one of the examples of the relationship between the viewing distance parameter, the image quality level and the type of the recording medium, and the recording mode.

TABLE 4

| TYPE OF RECORDING MEDIUM | IMAGE QUALITY LEVEL | | VIEWING DISTANCE (mm) 0–349 | 350–649 | 650–999 | 1000–1399 | 1400–2199 | 2200–3799 | 3800- |
|---|---|---|---|---|---|---|---|---|---|
| PAPER OR VINYL CHLORIDE SYSTEM | 1 (HIGH QUALITY) | RESOLUTION(dpi) | 720 × 1440 | 720 × 1440 | 720 × 1440 | 360 × 720 | 360 × 720 | 360 × 720 | 360 × 360 |
| | | THE NUMBER OF PATHS | 16 | 12 | 8 | 6 | 4 | 2 | 1 |
| | | RECORDING DIRECTION | ONE-WAY | TWO-WAY | TWO-WAY | TWO-WAY | TWO-WAY | TWO-WAY | TWO-WAY |
| | 2 (STANDARD) | RESOLUTION(dpi) | 720 × 1440 | 720 × 1440 | 360 × 720 | 360 × 720 | 360 × 720 | 360 × 720 | 360 × 360 |
| | | THE NUMBER OF PATHS | 12 | 8 | 6 | 4 | 2 | 1 | 1 |
| | | RECORDING DIRECTION | TWO-WAY | TWO-WAY | TWO-WAY | TWO-WAY | TWO-WAY | TWO-WAY | TWO-WAY |
| | 3 (HIGH SPEED) | RESOLUTION(dpi) | 720 × 1440 | 360 × 720 | 360 × 720 | 360 × 720 | 360 × 720 | 360 × 720 | 360 × 360 |
| | | THE NUMBER OF PATHS | 8 | 6 | 4 | 2 | 1 | 1 | 1 |
| | | RECORDING DIRECTION | TWO-WAY | TWO-WAY | TWO-WAY | TWO-WAY | TWO-WAY | TWO-WAY | TWO-WAY |
| PET SYSTEM | 1 (HIGH QUALITY) | RESOLUTION(dpi) | 720 × 720 | 720 × 720 | 720 × 720 | 360 × 360 | 360 × 360 | 360 × 360 | 360 × 360 |
| | | THE NUMBER OF PATHS | 8 | 6 | 4 | 3 | 2 | 1 | 1 |
| | | RECORDING DIRECTION | ONE-WAY | TWO-WAY | TWO-WAY | TWO-WAY | TWO-WAY | TWO-WAY | TWO-WAY |
| | 2 (STANDARD) | RESOLUTION(dpi) | 720 × 720 | 720 × 720 | 360 × 360 | 360 × 360 | 360 × 360 | 360 × 360 | 360 × 360 |
| | | THE NUMBER OF PATHS | 6 | 4 | 3 | 2 | 1 | 1 | 1 |
| | | RECORDING DIRECTION | TWO-WAY | TWO-WAY | TWO-WAY | TWO-WAY | TWO-WAY | TWO-WAY | TWO-WAY |
| | 3 (HIGH SPEED) | RESOLUTION(dpi) | 720 × 720 | 360 × 360 | 360 × 360 | 360 × 360 | 360 × 360 | 360 × 360 | 360 × 360 |
| | | THE NUMBER OF PATHS | 4 | 3 | 2 | 1 | 1 | 1 | 1 |
| | | RECORDING DIRECTION | TWO-WAY | TWO-WAY | TWO-WAY | TWO-WAY | TWO-WAY | TWO-WAY | TWO-WAY |

According to Table 4, for example, when the viewing distance parameter is set as "0–349 mm", the image quality level is set as "LEVEL 1 (HIGH QUALITY)" and the type of the recording medium is set as "PAPER OR VINYL CHLORIDE SYSTEM", the recording mode where the resolution is "720×1440 dpi", the number of paths is "16" and the jetting direction is "ONE-WAY" is selected and set. Further, although not shown, other parameters such as the scan speed of the recording head or the amount of the jetting of the ink may be set in addition to above parameters.

Table 4 shows a group of the recording mode which provides the image qualities, which are recognized by human eyes that the image qualities are nearly equal each other, with respect to the various viewing distances, in every particular recording medium and particular image quality level. That is, even if the types of the recording medium are the same, and further, the image quality levels are the same, as the viewing distance is increased, the resolution can be decreased, and then, the number of paths can be decreased. Further, by decreasing the resolution and the number of the paths as described above, the recording speed can be increased.

Therefore, although the recording mode where the viewing distance parameter is "0–349 mm" has been described above, in the case that the viewing distance is increased, as shown in Table 4, the resolution and the number of paths is decreased, the two-way direction jetting is performed, further, although not shown, the scan speed of the recording head and the amount of the jetting of the ink is increased, as needed. Consequently, the image quality level which is nearly equal to the image qualities for other viewing distances can be acquired. Furthermore, although the recording mode where the image quality level is "LEVEL 1 (HIGH QUALITY)" has been described, in the case that the image quality level is lower, as also shown in Table 4, the resolution and the number of the paths is decreased, the two-way direction jetting is performed, further, although not shown, the scan speed of the recording head and the amount of the jetting of the ink is increased, as needed. Furthermore, although the recording mode where the recording medium is "PAPER OR VINYL CHLORIDE SYSTEM" having low surface energy with respect to the ink has been described, in the case that the recording medium is the one having higher surface energy such as a PET (polyethylene terephthalate), as also shown in Table 4, the resolution and the number of the paths is decreased, further, although not shown, the scan speed of the recording head and the amount of the jetting of the ink is increased, as needed.

The control unit 4 sends a driving control signal to the head driving unit 5, according to the recording mode set in the recording mode setting device 3. Then, the head driving unit 5 sends a driving signal to the recording unit 6, the driving signal driving a driving mechanism for the recording the data related to the image to be recorded which is obtained in the image processing data converter 2 according to the driving control signal.

The recording unit 6 activates the head driving mechanism according to the driving signal sent from the head driving unit 5, and makes the recording head jet the ink onto the recording medium. Further, the landed ink is cured by irradiation of a light, as needed.

According to the present embodiment, the recording quality (image quality) and the recording speed are controlled by selecting the recording mode based on the visual characteristics as follows, that is, generally, in the case that the recording medium is visually recognized from far, even if the image quality is low, viewers can feel that the recording medium has the same image quality, compared with the case where the image having the higher image quality is viewed up close. Consequently, the recording having a good balance between the actually demanded recording quality and productivity, can be performed.

Further, as shown in FIG. 2, the recording quality (image quality) and the recording speed is controlled, by selecting the recording mode in view of the set image quality level in addition to the above visual characteristics, that is, by setting the recording mode according to the required image quality level even when the viewing distances are the same. Consequently, the recording having a good balance between the actually demanded recording quality and productivity, can be performed.

Further, as shown in Table 3, the recording quality (image quality) and the recording speed is controlled, by selecting the recording mode in view of the type of the recording medium such as material, surface condition, transparency, gloss, fluorescence intensity characteristic, in addition to the above visual characteristics. That is, even if the image quality levels are the same when the same viewing distances are set, the recording mode can be changed also according to the difference of the type of the recording medium, for example, the difference whether the ink permeability of the recording medium is high or low. Consequently, the recording having a good balance between the actually demanded recording quality and productivity, can be performed.

Further, as shown in Table 4, the recording quality (image quality) and the recording speed is controlled, by selecting the recording mode in view of the set image quality level and specified type of the recording medium, in addition to the above visual characteristics. Consequently, the recording having a good balance between the actually demanded recording quality and productivity, can be performed.

Further, the number of the scans by recording unit 6 can be controlled to be increased or decreased by defining the recording mode based on the number of the scans (paths) by the recording unit 6 against the recording medium. Further, the movement of the recording unit 6 can be controlled to be two-way recording or one-way recording by defining the recording mode based on whether the recording is performed at both timings of the back-and-forth scan or only at one timing. Further, the recording quality and the recording speed can be controlled by adjusting the scan speed of the recording unit 6 at the recording by defining the recording mode based on the scan speed by the recording unit 6 on the recording medium, or by adjusting the scan speed of the recording head by defining the recording mode based on the recording resolution. Consequently, the recording having a good balance between the actually demanded recording quality and productivity, can be performed easily.

Further, if the host system 9 or the external device 10 performs the setting of the viewing distance and, as needed, the setting of the image quality level and the specifying of the type of the recording medium, the specifying of the recording mode can be controlled from a remote place.

Figure 6:
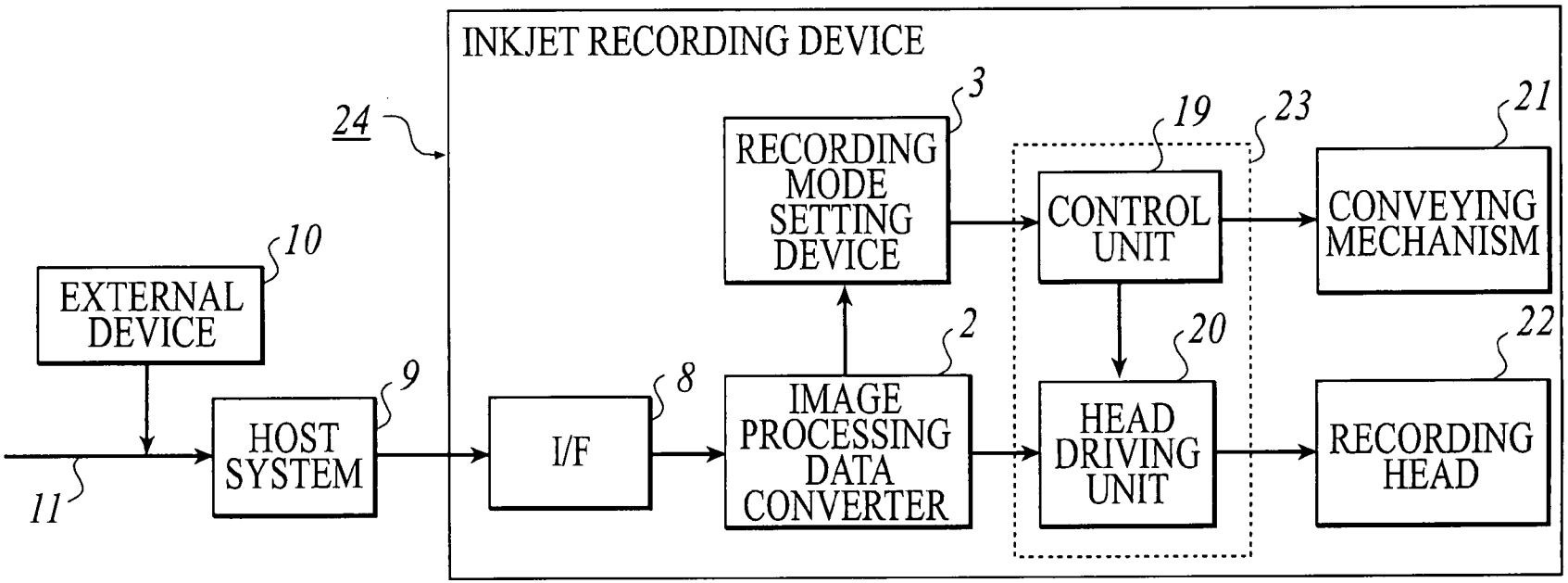
FIG. 6 is a block diagram showing a substantial part of a second embodiment of an inkjet recording device related to the present invention.

FIG. 6 shows a second embodiment of an inkjet recording device related to the present invention. An inkjet recording device 24 comprises a conveying mechanism 21 for conveying the recording medium along the conveying direction of the recording medium from downstream side to the recording area of a recording head 22, and the recording head 22 where an ink jetting port for jetting the ink onto the recording medium is provided.

In FIG. 6, the image processing data converter 2, the recording mode setting device 3, the host system 9, the external device 10 and the network 11 are same as those used in the first embodiment shown in FIGS. 1 to 5.

Incidentally, the recording mode set in the recording mode setting device 3 is set based on the parameters such as the resolution, the conveying speed of the recording medium and the amount of the jetting of the ink.

A control device 23 controls the operations of the conveying mechanism 21 and recording head 22 so that the recording according to the set recording mode can be performed. The control device 23 comprises a head driving unit 20 for driving the recording head 22, and a control unit 19 for controlling the operation of the conveying mechanism 21 and for instructing the head driving unit 20 according to the recording mode.

The control unit 19 comprises, for example, a CPU, a ROM, a RAM (not shown). The control unit 19 develops a processing program, which is recorded in the ROM, to the RAM, and make the CPU execute the processing program. The control unit 19 controls an conveying operation, in particular, the conveying speed of the conveying mechanism 21 for the recording medium. Further the control unit 19 send a signal, which provides an instruction particularly related to the resolution and the amount of the jetting of the ink, to the head driving unit 20 so as to activate the recording head 22 according to the recording mode. Further, the head driving unit 20 drives the recording head 22 for recording data related to the image to be recorded which is obtained in the image processing data converter 2.

The conveying mechanism 21 takes the recording medium from a supply unit which is not shown, and conveys the recording medium to the recording area of the recording head 22. Then, after the recording has been performed according to the controlling operation by the control unit 19 along with the ink jetting operation by the recording head 20, the conveying mechanism 21 further conveys the recording medium to an exit unit.

The recording head 22 is so-called line head type head, and comprises a fixed recording head comprising an array of nozzles extending along the recording width of the recording medium. The recording head 22 forms an image by conveying the recording medium in the recording width direction and the vertical direction.

Further, the ink and the recording medium described in the above-mentioned first embodiment can be cited as those used in the present embodiment.

Next, an operation of the present invention will be described.

The input image data sent to the inkjet recording device 24 is decoded as predetermined, converted into a pixel value and so on, in the image processing data converter 2. The obtained data is sent to the recording mode setting device 3 and the head driving unit 20.

When the recording mode setting device 3 is configured as shown in FIG. 2, the parameter corresponding to the viewing distance for the recording medium is set in the viewing distance setting unit 12. Further, in the recording mode setting unit 13, the recording mode is set based on the parameter set in the viewing distance setting unit 12. Then, the recording mode is sent to the control unit 19. The following Table 5 shows one of the examples of the relationship between the viewing distance parameter and the recording mode. Incidentally, although not show, the input for the setting of the distance can be also performed in the host system 9 or the external device 10.

TABLE 5

| | VIEWING DISTANCE(mm) | | | | | | |
|---|---|---|---|---|---|---|---|
| | 0–349 | 350–649 | 650–999 | 1000–1399 | 1400–2199 | 2200–3799 | 3800- |
| RESOLUTION(dpi) | 1200 × 2400 | 1200 × 1200 | 1200 × 1200 | 600 × 600 | 600 × 600 | 600 × 600 | 600 × 600 |
| CONVEYING SPEED(mm/s) | 75 | 150 | 300 | 300 | 600 | 600 | 600 |

According to Table 5, for example, when the viewing distance parameter is set as "0–349 mm", the recording mode where the resolution is "1200×2400 dpi", the conveying speed of the recording medium is "75 mm/s" is selected and set. Further, although not shown, other parameters such as the amount of the jetting of the ink may be set in addition to above parameters.

Table 5 shows a group of the recording mode which provides the image qualities, which are recognized by human eyes that the image qualities are nearly equal each other, with respect to the various viewing distances. That is, as the viewing distance is increased, the resolution can be decreased, and then, the conveying speed can be increased. Further, by decreasing the resolution and increasing the conveying speed of the recording medium as described above, the recording speed can be increased.

Therefore, although the recording mode where the viewing distance parameter is "0–349 mm" has been described above, in the case that the viewing distance is increased, as shown in Table 5, the resolution is decreased, the conveying speed is increased, and further, although not shown, the amount of the jetting of the ink is increased, as needed. Consequently, the image quality level which is nearly equal to the image qualities for other viewing distances can be acquired.

Further, when the recording mode setting device 3 is configured as shown in FIG. 3, the parameter corresponding to the viewing distance for the recording medium is set in the viewing distance setting unit 12. Further, in the image quality level setting unit 14, the intended image quality level is set. Incidentally, although not shown, the input for the setting of the distance and the input for the setting of the image quality level can be also performed in the host system 9 or the external device 10. Incidentally, the image quality level is as described in the first embodiment.

In the recording mode setting unit 15, the recording mode is set based on the parameter which is set in the viewing distance setting unit 12 and the image quality level which is set in the image quality level setting unit 14. Then, the recording mode is sent to the control unit 19. The following Table 6 shows one of the examples of the relationship between the viewing distance parameter and the image quality level, and the recording mode.

TABLE 6

| IMAGE QUALITY LEVEL | | VIEWING DISTANCE(mm) 0–349 | 350–649 | 650–999 | 1000–1399 | 1400–2199 | 2200–3799 | 3800- |
|---|---|---|---|---|---|---|---|---|
| 1 (HIGH QUALITY) | RESOLUTION(dpi) | 1200 × 2400 | 1200 × 1200 | 1200 × 1200 | 600 × 600 | 600 × 600 | 600 × 600 | 600 × 600 |
| | CONVEYING SPEED(mm/s) | 75 | 150 | 300 | 300 | 600 | 600 | 600 |
| 2 (STANDARD) | RESOLUTION(dpi) | 1200 × 1200 | 1200 × 1200 | 600 × 600 | 600 × 600 | 600 × 600 | 600 × 600 | 600 × 600 |
| | CONVEYING SPEED(mm/s) | 150 | 300 | 300 | 600 | 600 | 600 | 600 |
| 3 (HIGH SPEED) | RESOLUTION(dpi) | 1200 × 1200 | 600 × 600 | 600 × 600 | 600 × 600 | 600 × 600 | 600 × 600 | 600 × 600 |
| | CONVEYING SPEED(mm/s) | 300 | 300 | 600 | 600 | 600 | 600 | 600 |

According to Table 6, for example, when viewing distance parameter is set as "0–349 mm" and the image quality level is set as "LEVEL 1 (HIGH QUALITY)", the recording mode where the resolution is "1200×2400 dpi", the conveying speed of the recording medium is "75 mm/s" is selected and set. Further, although not shown, other parameters such as the amount of the jetting of the ink may be set in addition to above parameters.

Table 6 shows a group of the recording mode which provides the image qualities, which are recognized by human eyes that the image qualities are nearly equal each other, with respect to the various viewing distances, in every image quality level. That is, even if the image quality levels are the same, as the viewing distance is increased, the resolution can be decreased, and then, the conveying speed of the recording medium can be increased. Further, by decreasing the resolution and increasing the conveying speed of the recording medium as described above, the recording speed can be increased.

Therefore, although the recording mode where the viewing distance parameter is "0–349 mm" has been described above, in the case that the viewing distance is increased, as shown in Table 6, the resolution is decreased, the conveying speed of the recording medium is increased, and further, although not shown, the amount of the jetting of the ink is increased, as needed. Consequently, the image quality level which is nearly equal to the image qualities for other viewing distances can be acquired. On the other hand, although the recording mode where the image quality level is "LEVEL 1 (HIGH QUALITY)" has been described, in the case that the image quality level is lower, as also shown in Table 6, the resolution is decreased, the conveying speed of the recording medium is increased, further, although not shown, the amount of the jetting of the ink is increased, as needed.

Further, when the recording mode setting device 3 is configured as shown in FIG. 4, the parameter corresponding to the viewing distance for the recording medium is set in the viewing distance setting unit 12. Further, in the recording medium specifying unit 16, the type of the recording medium on which the recording will be performed is specified. Incidentally, although not shown, the input for the setting of the distance and the input for the specifying of the type of the recording medium can be also performed in the host system 9 or the external device 10.

In the recording mode setting unit 17, the recording mode is set based on the parameter which is set in the viewing distance setting unit 12 and the type of the recording medium which is specified in the recording medium specifying unit 16. Then, the recording mode is sent to the control unit 19. The following Table 7 shows one of the examples of the relationship between the viewing distance parameter and the type of the recording medium, and the recording mode.

TABLE 7

| TYPE OF RECORDING MEDIUM | | VIEWING DISTANCE(mm) 0–349 | 350–649 | 650–999 | 1000–1399 | 1400–2199 | 2200–3799 | 3800- |
|---|---|---|---|---|---|---|---|---|
| PAPER OR VINYL CHLORIDE SYSTEM | RESOLUTION(dpi) | 1200 × 2400 | 1200 × 1200 | 1200 × 1200 | 600 × 600 | 600 × 600 | 600 × 600 | 600 × 600 |
| | CONVEYING SPEED(mm/s) | 75 | 150 | 300 | 300 | 600 | 600 | 600 |
| PET SYSTEM | RESOLUTION(dpi) | 1200 × 1200 | 1200 × 1200 | 600 × 600 | 600 × 600 | 600 × 600 | 600 × 600 | 600 × 300 |
| | CONVEYING SPEED(mm/s) | 150 | 300 | 300 | 600 | 600 | 600 | 1200 |

According to Table 7, for example, when the viewing distance parameter is set as "0–349 mm" and the type of the recording medium is set as "PAPER OR VINYL CHLORIDE SYSTEM", the recording mode where the resolution is "1200×2400 dpi", the conveying speed of the recording medium is "75 mm/s" is selected and set. Further, although not shown, other parameters such as the amount of the jetting of the ink may be set in addition to above parameters.

Table 7 shows a group of the recording mode which provides the image qualities, which are recognized by human eyes that the image qualities are nearly equal each other, with respect to the various viewing distances, in every type of different recording medium. That is, even if the types of the recording medium are the same, as the viewing distance is increased, the resolution can be decreased, and then, the conveying speed of the recording medium can be increased. Further, by decreasing the resolution and by increasing the conveying speed of the recording medium as described above, the recording speed can be increased.

Therefore, although the recording mode where the viewing distance parameter is "0–349 mm" has been described above, in the case that the viewing distance is increased, as shown in Table 7, the resolution is decreased, the conveying speed is increased, and further, although not shown in Table 7, the amount of the jetting of the ink is increased, as needed. Consequently, the image quality level which is nearly equal to the image qualities for other viewing distances can be acquired. On the other hand, although the recording mode where the recording medium is "PAPER OR VINYL CHLORIDE SYSTEM" having low surface energy with respect to the ink has been described, in the case that the recording medium is the one having higher surface energy such as a PET (polyethylene terephthalate), as shown in Table 7, the resolution is decreased, the conveying speed of the recording medium is increased, and further, although not shown, the amount of the jetting of the ink is increased, as needed.

Further, when the recording mode setting device 3 is configured as shown in FIG. 5, the parameter corresponding to the viewing distance for the recording medium is set in the viewing distance setting unit 12. Further, in the image quality level setting unit 14, the image quality level setting is set, and in the recording medium specifying unit 16, the type of the recording medium on which the recording will be performed is specified. Incidentally, although not shown, the input for the setting of the distance, the input for the setting of the image quality level, and the input for the specifying of the type of the recording medium can be also performed in the host system 9 or the external device 10.

In the recording mode setting unit 18, the recording mode is set based on the parameter set in the viewing distance setting unit 12, the image quality level set in the image quality level setting unit 14 and the type of the recording medium specified in the recording medium specifying unit 16. Then, the recording mode is sent to the control unit 19. The following Table 8 shows one of the examples of the relationship between the viewing distance parameter, the image quality level and the type of the recording medium, and the recording mode.

human eyes that the image qualities are nearly equal each other, with respect to the various viewing distances, in every particular recording medium and particular image quality level. That is, even if the types of the recording medium are the same, and further, the image quality levels are the same, as the viewing distance is increased, the resolution can be decreased, and then, the conveying speed of the recording medium can be increased. Further, by decreasing the resolution and by increasing the conveying speed of the recording medium as described above, the recording speed can be increased.

Therefore, although the recording mode where the viewing distance parameter is "0–349 mm" has been described above, in the case that the viewing distance is increased, as shown in Table 8, the resolution is decreased, the conveying speed of the recording medium is increased, and further, although not shown, the amount of the jetting of the ink is increased, as needed. Consequently, the image quality level which is nearly equal to the image qualities for other viewing distances can be acquired. Furthermore, although the recording mode where the image quality level is "LEVEL 1 (HIGH QUALITY)" has been described, in the case that the image quality level is lower, as also shown in Table 8, the resolution is decreased, the conveying speed of the recording medium is increased, and further, although not shown, the amount of the jetting of the ink is increased, as needed. Furthermore, although the recording mode where the recording medium is "PAPER OR VINYL CHLORIDE SYSTEM" having low surface energy with respect to the ink has been described, in the case that the recording medium

TABLE 8

| TYPE OF RECORDING MEDIUM | IMAGE QUALITY LEVEL | | VIEWING DISTANCE (mm) 0–349 | 350–649 | 650–999 | 1000–1399 | 1400–2199 | 2200–3799 | 3800- |
|---|---|---|---|---|---|---|---|---|---|
| PAPER OR VINYL CHLORIDE SYSTEM | 1 (HIGH QUALITY) | RESOLUTION(dpi) | 1200 × 2400 | 1200 × 1200 | 1200 × 1200 | 600 × 600 | 600 × 600 | 600 × 600 | 600 × 600 |
| | | CONVEYING SPEED(mm/s) | 75 | 150 | 300 | 300 | 600 | 600 | 600 |
| | 2 (STANDARD) | RESOLUTION(dpi) | 1200 × 1200 | 1200 × 1200 | 600 × 600 | 600 × 600 | 600 × 600 | 600 × 600 | 600 × 600 |
| | | CONVEYING SPEED(mm/s) | 150 | 300 | 300 | 600 | 600 | 600 | 600 |
| | 3 (HIGH SPEED) | RESOLUTION(dpi) | 1200 × 1200 | 600 × 600 | 600 × 600 | 600 × 600 | 600 × 600 | 600 × 600 | 600 × 600 |
| | | CONVEYING SPEED(mm/s) | 300 | 300 | 600 | 600 | 600 | 600 | 600 |
| PET SYSTEM | 1 (HIGH QUALITY) | RESOLUTION(dpi) | 1200 × 1200 | 1200 × 1200 | 600 × 600 | 600 × 600 | 600 × 600 | 600 × 600 | 600 × 300 |
| | | CONVEYING SPEED(mm/s) | 150 | 300 | 300 | 600 | 600 | 600 | 1200 |
| | 2 (STANDARD) | RESOLUTION(dpi) | 1200 × 1200 | 600 × 600 | 600 × 600 | 600 × 600 | 600 × 600 | 600 × 300 | 600 × 300 |
| | | CONVEYING SPEED(mm/s) | 300 | 300 | 600 | 600 | 600 | 1200 | 1200 |
| | 3 (HIGH SPEED) | RESOLUTION(dpi) | 600 × 600 | 600 × 600 | 600 × 600 | 600 × 600 | 600 × 300 | 600 × 300 | 600 × 300 |
| | | CONVEYING SPEED(mm/s) | 300 | 600 | 600 | 600 | 1200 | 1200 | 1200 |

According to Table 8, for example when the viewing distance parameter is set as "0–349 mm", the image quality level is set as "LEVEL 1 (HIGH QUALITY)" and the type of the recording medium is set as "PAPER OR VINYL CHLORIDE SYSTEM", the recording mode where the resolution is "1200×2400 dpi", the conveying speed of the recording medium is "75 mm/s" is selected and set. Further, although not shown, other parameters such as the scan speed of the recording head or the amount of the jetting of the ink may be set in addition to above parameters.

Table 8 shows a group of the recording mode which provides the image qualities, which are recognized by the one having higher surface energy such as a PET (polyethylene terephthalate), as shown in Table 8, the resolution is decreased, the conveying speed of the recording medium is increased, and further, although not shown, the amount of the jetting of the ink is increased, as needed.

The control unit 19 activates the conveying mechanism 21 according to the conveying speed determined based on the recording mode set in the recording mode setting device 3. Further, the control unit 19 sends a driving control signal to the head driving unit 20. Then, the head driving unit 20 sends a driving signal to the recording head 22, the driving signal driving the recording head 22 for the recording the data related to the image to be recorded which is obtained in the image processing data converter 2 according to the driving control signal, that is, according to the resolution determined based on the recording mode and, as needed, the amount of the jetting of the ink.

The conveying mechanism 22 jets the ink toward the recording medium according to the driving signal sent from the head driving unit 20, that is according to the resolution set based on the recording mode and, as needed, the amount off the jetting of the ink. Further, the landed ink is cured by irradiation of a light, as needed.

According to the present embodiment, the recording quality (image quality) and the recording speed are controlled by selecting the recording mode based on the visual characteristics as follows, that is, generally, in the case that the recording medium is visually recognized from far, even if the image quality is low, viewers can feel that the recording medium has the same image quality, compared with the case where the image having the higher image quality is viewed up close. Consequently, the recording having a good balance between the recording quality which is actually demanded and the productivity can be performed.

Further, as shown in FIG. 6, the recording quality (image quality) and the recording speed is controlled, by selecting the recording mode in view of the set image quality level, in addition to the above visual characteristics, that is, by setting the recording mode according to the required image quality level even when the viewing distances are the same. Consequently, the recording having a good balance between the actually demanded recording quality and productivity, can be performed.

Further, as shown in Table 7, the recording quality (image quality) and the recording speed is controlled, by selecting the recording mode in view of the type of the recording medium such as material, surface condition, transparency, gloss, fluorescence intensity characteristic, in addition to the above visual characteristics. That is, even if the image quality levels are the same when the same viewing distances are set, the recording mode can be changed also according to the difference of the type of the recording medium, for example, the difference whether the ink permeability of the recording medium is high or low. Consequently, the recording having a good balance between the actually demanded recording quality and productivity, can be performed.

Further, as shown in Table 8, the recording quality (image quality) and the recording speed is controlled, by selecting the recording mode in view of the set image quality level and specified type of the recording medium, in addition to the above visual characteristics. Consequently, the recording having a good balance between the actually demanded recording quality and productivity, can be performed.

Further, by defining the recording mode based on the conveying speed of the recording medium which is conveyed by the conveying mechanism 21, and accordingly, by adjusting the conveying speed of the recording medium according to the recording mode, the recording quality and the recording speed can be controlled. Consequently, the recording having a good balance between the actually demanded recording quality and productivity, can be performed easily.

Further, if the host system 9 or the external device 10 performs the setting of the viewing distance and, as needed, the setting of the image quality level and the specifying of the type of the recording medium, the specifying of the recording mode can be controlled from a remote place.

Figure 7:
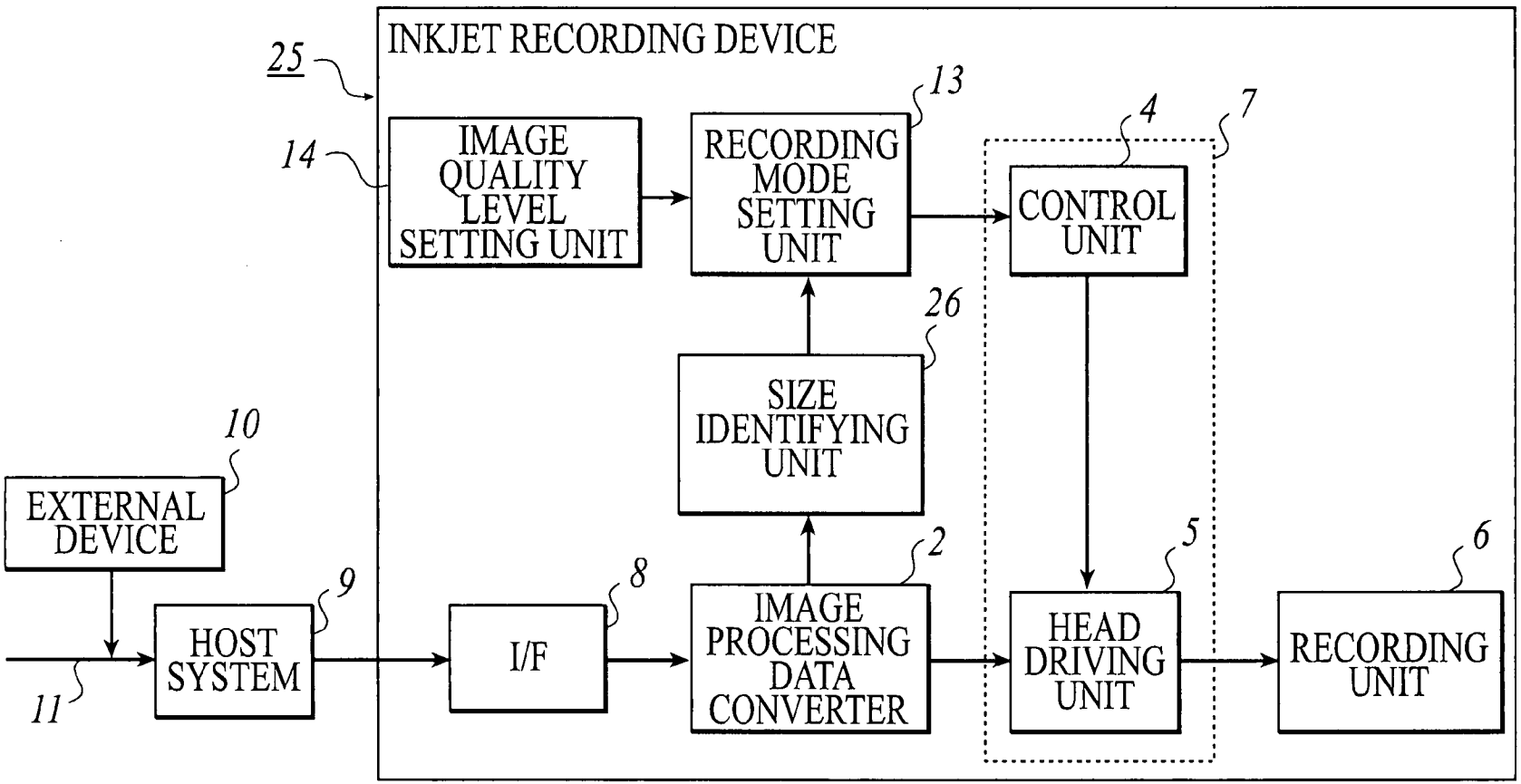
FIG. 7 is a block diagram showing a substantial part of a third embodiment of an inkjet recording device related to the present invention.

FIG. 7 shows a third embodiment of an inkjet recording device related to the present invention. The inkjet recording device 25 comprises a recording unit 6 comprising recording heads for jetting ink of a plurality of colors onto a recording medium, and a conveying mechanism, which is not shown, for conveying the recording medium from a feeding unit to the recording heads, further to an exit port.

For example, an encoding including a normal compression processing is performed to an image data sent from a host system 9 though an interface (I/F) 8. Therefore, in the inkjet recording device 25 in FIG. 7, an image processing data converter 2 decodes the inputted image data so as to change the inputted image data into the data of which data format can be processed in the inkjet recording device 25. Accordingly, the image processing data converter 2 sends the data related to an image to be recorded to a head driving unit 5, and the data related to the size of a recording area of an image (recording size) to a size identifying unit 26, respectively.

The size identifying unit 26 identifies the size of the area occupied by the image, and sends the result of the identification a recording mode setting unit 3.

The image quality level setting unit 14 specifies an image quality level intended by a user, and sends the image quality level to the recording mode setting unit 15. The image quality level may be specified by selecting it, for example, from image quality levels provided beforehand as pull-down menus in three stages or the like, or may be specified by inputting it directly.

The recording mode setting unit 13 sets the recording mode for the recording onto the recording medium, based on the recording size which is identified in the size identifying unit 26 and the image quality level which is specified in the image quality level setting unit 14, and sends the recording mode to a control unit 4. Incidentally, this recording mode is set based on the parameters such as a resolution, the number of scans (the number of paths) of the recording head, a recording (jetting) direction (that is, the one-way recording or the two-way recording), a scan speed, an amount of the jetting of the ink.

A control device 7 controls the operations of the recording unit 6 so that the recording according to the set recording mode can be performed. The control device 23 comprises a head driving unit 5 for driving the recording unit 6, and a control unit 4 for sending an instruction according to the recording mode to the head driving unit 5.

The control unit 4 comprises, for example, a CPU, a ROM and a RAM (not shown). The control unit 4 develops a processing program, which is recorded in the ROM, to the RAM, and accordingly, makes the CPU execute the processing program. The control unit 4 sends a signal, which instructs the recording unit 6 to operate according to the recording mode set by the recording mode setting unit 13, to the head driving unit 5. Further, the head driving unit 5 drives the recording unit 6 so that the data related to the image to be recorded which is obtained in the image processing data converter 2 can be recorded according to the signal sent from the control unit 4.

The recording unit 6 comprises an inkjet type recording head, and a head scanning mechanism for making the recording head scan in a direction perpendicular to a conveying direction of the recording medium.

The recording head is so-called serial type head, and comprises a plurality of nozzles for jetting ink. In the case that the ink of a plurality of colors are used, the recording heads are provided respectively with respect to each of colors, and each of the ink respectively having different colors is jetted from each of the recording heads.

As the ink charged in the recording head, cationic polymerization system ink having high reactivity for the UV curable property is preferably used. Further, in the case that the UV curable ink is used, preferably, an UV light source is preferably used so as to cure the ink jetted onto the recording medium by irradiation of the ultraviolet rays to the ink. Further, as the light source, a cold cathode fluorescent tube, a hot cathode fluorescent tube, a low pressure mercury lamp or the like, which irradiates ultraviolet rays, can be cited. In the case that the UV curable ink and the UV light source are used, as the recording medium, the recording medium having no ink absorbability, that is, having no ink absorber layer, can be used.

Although not shown, the head scanning mechanism comprises a carriage on which the recording head and if necessary UV light source is mounted, a guide for making the carriage scan in the direction perpendicular to the conveying direction of the recording medium, and the like.

The host system 9 is connected to the inkjet recording device 25 through the interface 8. Furthermore, an external device 10 is connected to the host system 9 through a network 11. The host system 9 and the external device 10 send the image data for the recording to the inkjet recording device 25, and additionally, perform the input for the control of the operation of the whole inkjet recording device 1. Further, the host system 9 and the external device 10 can perform the input for the setting in the image quality level setting unit 14.

Next, an operation in the present invention will be described.

The input image data sent to the inkjet recording device 25 is decoded as predetermined, converted into a pixel value and so on, in the image processing data converter 2. The data related to the image to be recorded such as a pixel number is sent to the head driving unit 5. The data related to the size of a recording area of the image (recording size) is sent to the size identifying unit 26, respectively.

In the size identifying unit 26, the recording size of the image of the input image data is identified. As the recording size, the actual size of the image to be recorded can be specified based on the length of the diagonal line of the image when the image is considered as approximate quadrangular shape. It is known that the length of the diagonal line is equal to the viewing distance from which human actually view the image.

In the image quality level setting unit 14, the parameter corresponding to the image quality level, that is, so-called noise level, which is intended by a user, is inputted. The term "noise" cited here is defined as the standard deviation of the brightness and the chromaticity in the uniform color space on the basis of the human perceptual model, as shown in "The Journal of the Society of Photographic Science and Technology of Japan, Vol. 57, No. 6 (1994), Pages 392 to 398". The image quality level set here corresponds to the noise level which is configured by grouping the degrees of the noise. Concretely, the levels are represented as each of levels such as "HIGH QUALITY", "STANDARD", "HIGH SPEED". Incidentally, when the "HIGH QUALITY" level is selected, the high quality instead of the low recording speed can be achieved. In addition, when the "HIGH SPEED" level is selected, the amount of the time required for the recording can be decreased, although the recording quality (image quality) is lower.

In the recording mode setting unit 13, the recording mode is set based on the recording size which is specified in the size identifying unit 26 and the image quality level which is set in the image quality level setting unit 14. The following Table 9 shows one of the examples of the relationship between the recording size and the recording mode in a certain image quality level.

TABLE 9

| | | RECORDING MODE | |
|---|---|---|---|
| RECORDING SIZE | VIEWING DISTANCE (mm) | RESOLUTION (dpi) | THE NUMBER OF PATHS |
| 210 × 297 mm (EQUIV.A4) | 300 | 1440 × 720 | 16 |
| 297 × 420 mm (EQUIV.A3) | 500 | 1440 × 720 | 12 |
| 420 × 594 mm (EQUIV.A2) | 700 | 1440 × 720 | 8 |
| 594 × 841 mm (EQUIV.A1) | 1000 | 720 × 360 | 6 |
| 841 × 1189 mm (EQUIV.A0) | 1500 | 720 × 360 | 4 |
| 1600 mm WIDE ROLL PAPER (EQUIV.62 inch) | 3000 | 720 × 360 | 2 |
| 3200 mm WIDE ROLL PAPER (EQUIV.124 inch) | 5000 | 360 × 360 | 1 |

In Table 9, when the size identifying unit 26 identifies the recording size as "210×297 mm", the recording mode setting unit 13 sets the viewing distance from which the image is viewed as approximately "300 mm" Accordingly, the recording mode setting unit 13 sets the recording mode where the resolution is "1440×720 dpi" and the number of the paths is "16". In addition to that, parameters such as a recording (jetting) direction (that is, one-way recording or two-way recording), scan speed and an amount of the jetting of the ink are also set. As above, the recording mode is determined based on not only the image quality level inputted by a user, but also consideration of the recording size.

As for the recording mode set in the recording mode setting unit 13, when the image quality level is increased even if the recording sizes are the same, the resolution is decreased, the number of the paths is increased, the recording direction is set as one-way and the scan speed is decreased, and then, the amount of the jetting of the ink is decreased. By controlling the recording quality (image quality) and the recording speed as above, the recording having a good balance between the actually demanded recording quality and productivity, can be performed.

The control unit 4 sends a driving control signal to the head driving unit 5, according to the recording mode set in the recording mode setting device 13. Then, the head driving unit 5 sends a driving signal to the recording unit 6, the driving signal driving a driving mechanism for the recording the data related to the image to be recorded which is obtained in the image processing data converter 2 according to the driving control signal.

The recording unit 6 activates the head driving mechanism according to the driving signal sent from the head driving unit 5, and makes the recording head jet the ink onto the recording medium. Further, the landed ink is cured by irradiation of a light, as needed.

According to the present embodiment, the recording mode is determined based on not only the image quality level inputted by a user, but also the consideration of the recording size. By performing the recording based on the recording mode, the recording having a good balance between the actually demanded recording quality and productivity, can be performed.

Further, the number of the scans by recording unit 6 can be controlled to be increased or decreased by defining the recording mode based on the number of the scans (paths) by the recording unit 6 against the recording medium. Further, the movement of the recording unit 6 can be controlled to be two-way recording or one-way recording by defining the recording mode based on whether the recording is performed at both timings of the back-and-forth scan or only at one timing. Further, the recording quality and the recording speed can be controlled by adjusting the scan speed of the recording unit 6 at the recording by defining the recording mode based on the scan speed by the recording unit 6 on the recording medium, or by adjusting the scan speed of the recording head by defining the recording mode based on the recording resolution. Consequently, the recording having a good balance between the actually demanded recording quality and productivity, can be performed easily.

Further, if the host system 9 or the external device 10 performs the setting of the viewing distance and, as needed, the setting of the image quality level and the specifying of the type of the recording medium, the specifying of the recording mode can be controlled from a remote place.

Figure 8:
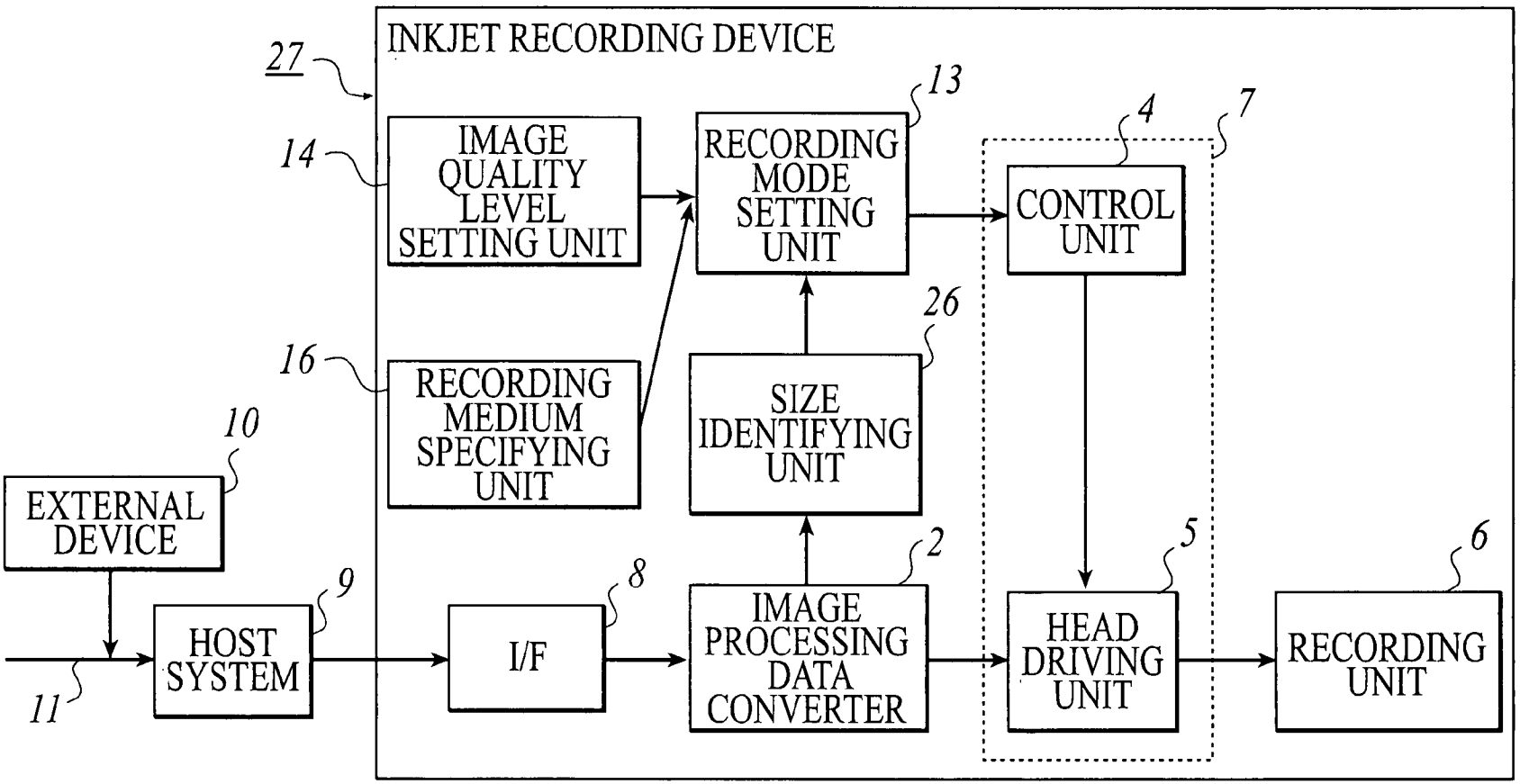
FIG. 8 is a block diagram showing a substantial part of a fourth embodiment of an inkjet recording device related to the present invention.

FIG. 8 shows a fourth embodiment of an inkjet recording device related to the present invention. The inkjet recording device 27 comprises a recording unit 6 comprising a recording heads for jetting ink of a plurality of colors onto a recording medium, and a conveying mechanism, which is not shown, for conveying the recording medium from a feeding unit to the recording heads, further to an exit port.

In FIG. 8, the image processing data converter 2, the size identifying unit 26, the image quality level setting unit 14, the control device 7 (the control unit 4 and the head driving unit 5) the recording unit 6, the host system 9, the external device 10 and the network 11 are same as those used in the third embodiment shown in FIG. 7.

The recording medium specifying unit 16 specifies the type of a recording medium, and sends the specified result to the recording mode setting unit 13. The type of a recording medium is specified from the concrete name of the substance or various properties such as material, surface condition, transparency, gloss, fluorescence intensity characteristic, or the like. The concrete method for the specifying is described in, for example, JP-Tokukai-2002-167082A. Further, the type of the recording medium can be specified by a manual input performed by a user in an input unit, which is not shown, comprising an operation panel or the like. Alternatively, the type of the recording medium may be specified by a manual input performed by a user in the host system 9 and the external device 10.

The recording mode setting unit 13 sets the recording mode for the recording onto the recording medium, based on the recording size identified in the size identifying unit 26, the image quality level specified in the image quality level setting unit 14, and the type of the recording medium specified in the recording media specifying unit 16. Then, the recording mode setting unit 13 sends the recording mode to a control unit 4. Incidentally, this recording mode is set based on the parameters such as a resolution, the number of scans (the number of paths) of the recording head, a recording (jetting) direction (that is, the one-way recording or the two-way recording), a scan speed, an amount of the jetting of the ink.

Further, the ink and the recording medium described in the above-mentioned third embodiment can be cited as those used in the present embodiment.

Next, an operation of the present invention will be described.

The input image data sent to the inkjet recording device 27 is decoded as predetermined, converted into a pixel value and so on, in the image processing data converter 2. The data related to the image to be recorded such as a pixel number is sent to the head driving unit 5. The data related to the size of a recording area of the image (recording size) is sent to the size identifying unit 26, respectively.

In the size identifying unit 26, the recording size of the image of the input image data is identified.

In the image quality level setting unit 14, a parameter corresponding to the image quality level, that is, so-called noise level, which is intended by a user, is inputted. Concretely, the parameter is represented as each level such as "HIGH QUALITY", "STANDARD" and "HIGH SPEED". Incidentally, when the level "HIGH QUALITY" is selected, the recording speed become slower, when the level "HIGH SPEED" is selected, the recording quality (image quality) becomes lower.

In the recording medium specifying unit 16, the type of the recording medium is specified.

In the recording mode setting unit 13, the recording mode is set based on the recording size identified in the size identifying unit 26, the image quality level set in the image quality level setting unit 14, the type of the recording medium specified in the recording medium specifying unit 16. The recording mode is specified based on, for example, the resolution, the number of the paths, the recording direction or the like, as shown in FIG. 9.

FIG. 9 provides the image qualities which are recognized by human eyes that the image qualities are nearly equal each other with respect to the various viewing distances, in the recording modes with respect to the various recording sizes respectively based on the particular recording medium and the particular image quality (noise) level. That is, the larger the recording size is, the farther the viewing distance is. Therefore, the resolution can be decreased, and then, the number of paths can be decreased. Further, by decreasing the resolution and the number of the paths as described above, the recording speed can be increased. Accordingly, the problem that when the recording image is large, it takes a long time to recode the image, is solved.

Concretely, in FIG. 9, when the type of the recording medium (medium type) is specified as "PAPER OR VINYL CHLORIDE SYSTEM", the image quality level (noise level) is set as "HIGH QUALITY", and the recording size is identified as "210×297 mm (EQUIV. A4)", the recording mode setting unit 13 sets the viewing distance from which the image is viewed as approximately "300 mm". Accordingly, the recording mode setting unit 13 sets the recording mode where the resolution is "1440×720 dpi", the number of the paths is "16" and the recording direction is "ONE-WAY". In addition to that, parameters such as scan speed and an amount of the jetting of the ink are also set.

As for the recording mode set in the recording mode setting unit 13, when the image quality level is increased even if the recording sizes are the same, the resolution is increased, the number of the paths is increased, the recording direction is set as one-way and the scan speed is decreased, and then, the amount of the jetting of the ink is decreased. Furthermore, dot diameters of the ink after the landing onto the recording medium differ each other among the plurality of recording medium according to the difference of the type of the recording medium even if the recording sizes and the image quality levels are respectively the same. That is, for example, the dot diameter of the ink after the landing onto the recording medium of the polyethylene terephthalate (PET) tends to be larger than that of the paper. Therefore, as for the recording mode for the PET, compared with that for the paper, the amount of the jetting of the ink is decreased even if both resolutions are same each other, and the resolution is decreased even if both amounts of the jetting of the ink are same each other. By controlling the recording quality (image quality) and the recording speed as above, the recording having a good balance between the actually demanded recording quality and productivity, can be performed easily.

The control unit 4 sends a driving control signal to the head driving unit 5, according to the recording mode set in the recording mode setting device 13. Then, the head driving unit 5 sends a driving signal to the recording unit 6, the driving signal driving a driving mechanism for the recording the data related to the image to be recorded which is obtained in the image processing data converter 2 according to the driving control signal.

The recording unit 6 activates the head driving mechanism according to the driving signal sent from the head driving unit 5, and makes the recording head jet the ink onto the recording medium. Further, the landed ink is cured by irradiation of a light, as needed.

According to the present embodiment, the recording mode is determined based on not only the image quality level inputted by a user, but also the consideration of the recording size. By performing the recording based on the recording mode, the recording having a good balance between the actually demanded recording quality and productivity, can be performed.

Further, the number of the scans by recording unit 6 can be controlled to be increased or decreased by defining the recording mode based on the number of the scans (paths) by the recording unit 6 against the recording medium. Further, the movement of the recording unit 6 can be controlled to be two-way recording or one-way recording by defining the recording mode based on whether the recording is performed at both timings of the back-and-forth scan or only at one timing. Further, the recording quality and the recording speed can be controlled by adjusting the scan speed of the recording unit 6 at the recording by defining the recording mode based on the scan speed by the recording unit 6 on the recording medium, or by adjusting the scan speed of the recording head by defining the recording mode based on the recording resolution. Consequently, the recording having a good balance the recording having a good balance between the actually demanded recording quality and productivity, can be performed easily.

Further, by setting the recording mode according to the type of the recording medium, the recording mode can be changed also according to the difference of the type of the recording medium, for example, whether the ink permeability of the recording medium is high or low. Consequently, the recording having a good balance between the actually demanded recording quality and productivity, can be performed easily.

Further, if the host system 9 or the external device 10 performs the setting of the viewing distance and, as needed, the setting of the image quality level and the specifying of the type of the recording medium, the specifying of the recording mode can be controlled from a remote place.

Figure 10:
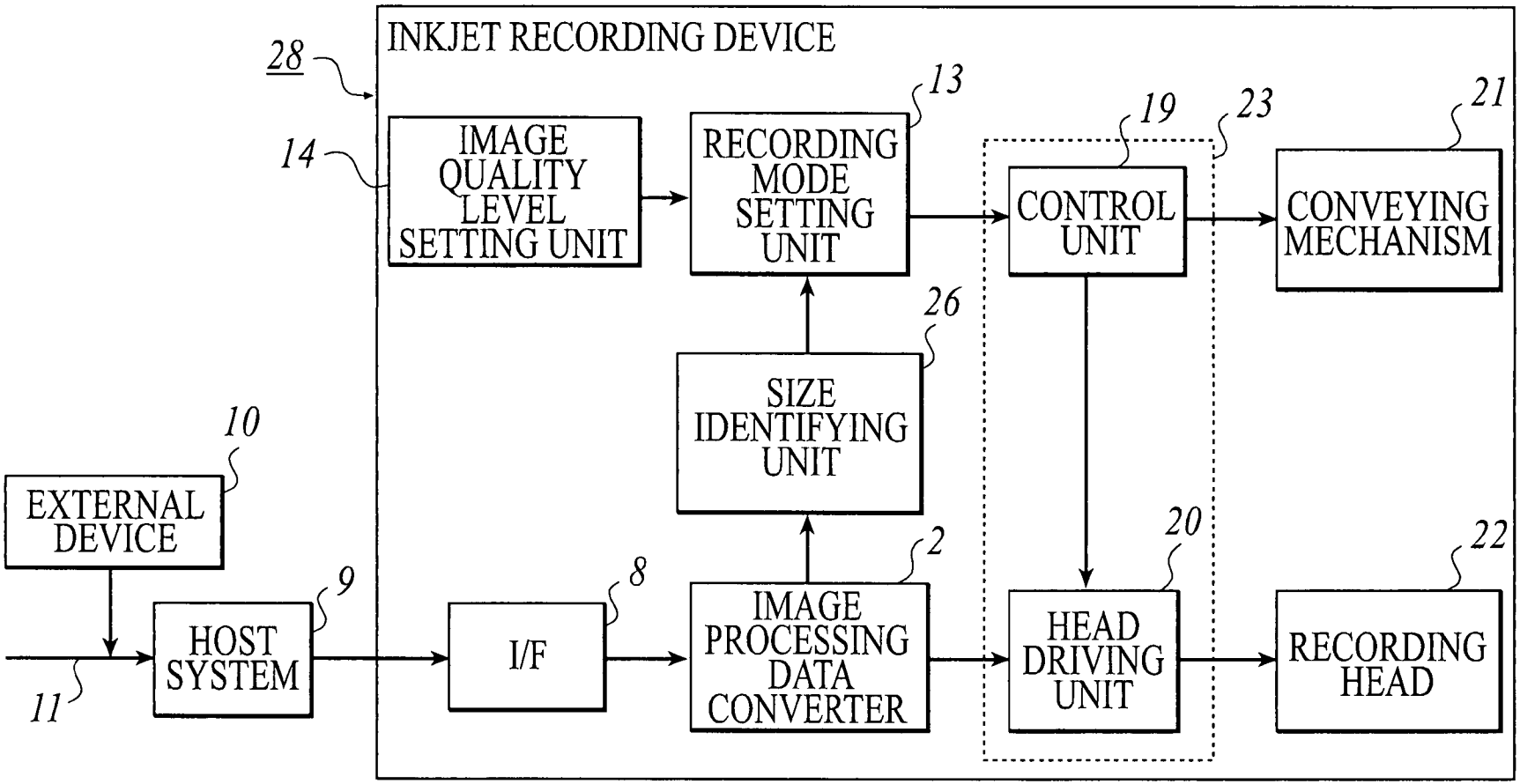
FIG. 10 is a block diagram showing a substantial part of a fifth embodiment of an inkjet recording device related to the present invention.

FIG. 10 shows a fifth embodiment of an inkjet recording device related to the present invention. An inkjet recording device 28 comprises a conveying mechanism 21 for conveying the recording medium along the conveying direction of the recording medium from downstream side to the recording area of a recording head 22, and the recording head 22 where an ink jetting port for jetting the ink onto the recording medium is provided.

In FIG. 10, the image processing data converter 2, the size identifying unit 26, the image quality level setting unit 14, the recording mode setting unit 13, the host system 9, the external device 10 and the network 11 are same as those used in the third embodiment shown in FIG. 7.

Incidentally, the recording mode set in the recording mode setting unit 13 is set based on the parameters such as the resolution, the conveying speed of the recording medium and the amount of the jetting of the ink.

A control device 23 controls the operations of the conveying mechanism 21 and recording head 22 so that the recording according to the set recording mode can be performed. The control device 23 comprises a head driving unit 20 for driving the recording head 22, and a control unit 19 for controlling the operation of the conveying mechanism 21 and for instructing the head driving unit 20 according to the recording mode.

The control unit 19 comprises, for example, a CPU, a ROM, a RAM (not shown). The control unit 19 develops a processing program, which is recorded in the ROM, to the RAM, and make the CPU execute the processing program. The control unit 19 controls an conveying operation, in particular, the conveying speed of the conveying mechanism 21 for the recording medium. Further the control unit 19 send a signal, which provides an instruction particularly related to the resolution and the amount of the jetting of the ink, to the head driving unit 20 so as to activate the recording head 22 according to the recording mode. Further, the head driving unit 20 drives the recording head 22 for recording data related to the image to be recorded which is obtained in the image processing data converter 2.

The conveying mechanism 21 takes the recording medium from a supply unit which is not shown, and conveys the recording medium to the recording area of the recording head 22. Then, after the recording has been performed according to the controlling operation by the control unit 19 along with the ink jetting operation by the recording head 20, the conveying mechanism 21 further conveys the recording medium to an exit unit.

The recording head 22 is so-called line head type head, and comprises a fixed recording head comprising an array of nozzles extending along the recording width of the recording medium. The recording head 22 forms an image by conveying the recording medium in the recording width direction and the vertical direction.

Further, the ink and the recording medium described in the above-mentioned third embodiment can be cited as those used in the present embodiment.

Next, an operation of the present invention will be described.

The input image data sent to the inkjet recording device 28 is decoded as predetermined, converted into a pixel value and so on, in the image processing data converter 2. The data related to the image to be recorded such as a pixel number is sent to the head driving unit 5. The data related to the size of a recording area of the image (recording size) is sent to the size identifying unit 26, respectively.

In the size identifying unit 26, the recording size of the image of the input image data is identified.

In the image quality level setting unit 14, a parameter corresponding to the image quality level, that is, so-called noise level, which is intended by a user, is inputted. Concretely, the parameter is represented as each level such as "HIGH QUALITY", "STANDARD" and "HIGH SPEED". Incidentally, when the level "HIGH QUALITY" is selected, the recording speed become slower, when the level "HIGH SPEED" is selected, the recording quality (image quality) become lower.

In the recording mode setting unit 13, the recording mode is set based on the recording size specified in the size identifying unit 26 and the image quality level set in the image quality level setting unit 14. The following Table 10 shows one of the examples of the relationship between the recording size and the recording mode in a certain image quality level.

TABLE 10

| RECORDING SIZE | VIEWING DISTANCE (mm) | RECORDING MODE RESOLUTION (dpi) | RECORDING MODE CONVEYING SPEED (mm/s) |
|---|---|---|---|
| 210 × 297 mm (EQUIV.A4) | 300 | 1200 × 2400 | 75 |
| 297 × 420 mm (EQUIV.A3) | 500 | 1200 × 1200 | 150 |
| 420 × 594 mm (EQUIV.A2) | 700 | 1200 × 1200 | 300 |
| 594 × 841 mm (EQUIV.A1) | 1000 | 600 × 600 | 300 |
| 841 × 1189 mm (EQUIV.A0) | 1500 | 600 × 600 | 600 |
| 1600 mm WIDE ROLL PAPER (EQUIV.62 inch) | 3000 | 600 × 600 | 600 |
| 3200 mm WIDE ROLL PAPER (EQUIV.124 inch) | 5000 | 600 × 600 | 600 |

In Table 10, when the size identifying unit 26 identifies the recording size as "210×297 mm", the recording mode setting unit 13 sets the viewing distance from which the image is viewed as approximately "300 mm". Accordingly, the recording mode setting unit 13 sets the recording mode where the resolution is "1200×2400 dpi" and the conveying speed is "75 mm/s". In addition to that, parameters such as an amount of the jetting of the ink are also set. As above, the recording mode is determined based on not only the image quality level inputted by a user, but also consideration of the recording size.

As for the recording mode set in the recording mode setting unit 13, when the image quality level is increased even if the recording sizes are the same, the resolution is increased and the conveying speed is decreased, and then, the amount of the jetting of the ink is decreased. By controlling the recording quality (image quality) and the recording speed as above, the recording having a good balance between the actually demanded recording quality and productivity, can be performed.

The control unit 19 activates the conveying mechanism 21 according to the conveying speed determined based on the recording mode set in the recording mode setting device 3. Further, the control unit 19 sends a driving control signal to the head driving unit 20. Then, the head driving unit 20 sends a driving signal to the recording head 22, the driving signal driving the recording head 22 for the recording the data related to the image to be recorded which is obtained in the image processing data converter 2 according to the driving control signal, that is, according to the resolution determined based on the recording mode and, as needed, the amount of the jetting of the ink.

The conveying mechanism 22 jets the ink toward the recording medium according to the driving signal sent from the head driving unit 20, that is according to the resolution set based on the recording mode and, as needed, the amount off the jetting of the ink. Further, the landed ink is cured by irradiation of a light, as needed.

According to the present embodiment, the recording mode is determined based on not only the image quality level inputted by a user, but also the consideration of the recording size. By performing the recording based on the recording mode, the recording having a good balance between the actually demanded recording quality and productivity, can be performed.

Further, by defining the recording mode based on the conveying speed of the recording medium which is conveyed by the conveying mechanism 21, and accordingly, by adjusting the conveying speed of the recording medium according to the recording mode, the recording quality and the recording speed can be controlled. Consequently, the recording having a good balance between the actually demanded recording quality and productivity, can be performed easily.

Further, if the host system 9 or the external device 10 performs the setting of the viewing distance and, as needed, the setting of the image quality level and the specifying of the type of the recording medium, the specifying of the recording mode can be controlled from a remote place.

Figure 11:
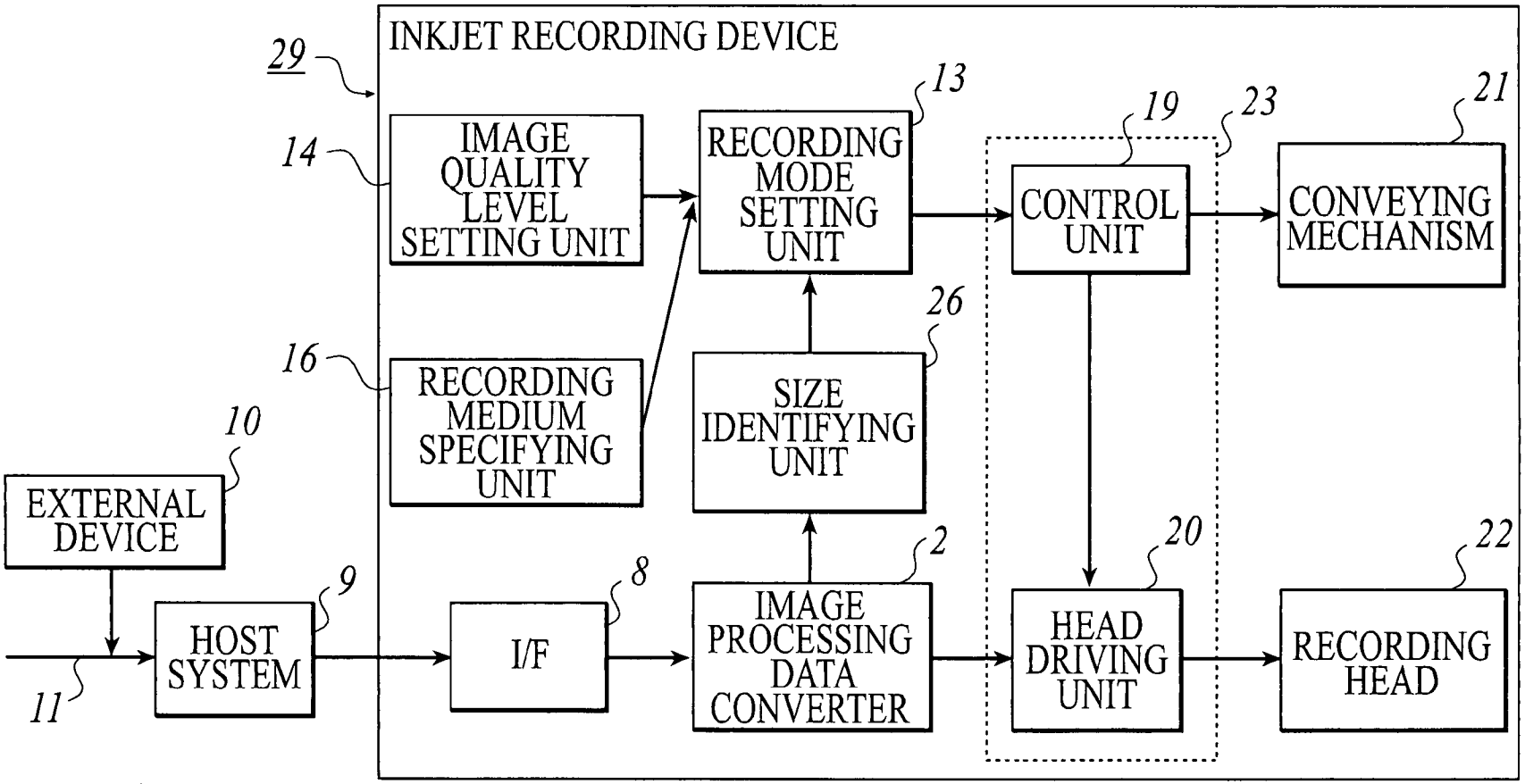
FIG. 11 is a block diagram showing a substantial part of a sixth embodiment of an inkjet recording device related to the present invention.

FIG. 11 shows a fifth embodiment of an inkjet recording device related to the present invention. An inkjet recording device 23 comprises a conveying mechanism 21 for conveying the recording medium along the conveying direction of the recording medium from downstream side to the recording area of a recording head 22, and the recording head 22 where an ink jetting port for jetting the ink onto the recording medium is provided.

In FIG. 11, the image processing data converter 2, the size identifying unit 26, the image quality level setting unit 14, the host system 9, the external device 10 and the network 11 are same as those used in the third embodiment shown in FIG. 7. Further, the recording medium specifying unit 16 and the recording mode setting unit 15 are same as those used in the fourth embodiment shown in FIG. 8. Furthermore, the control device 23 (the control unit 18 and the head driving unit 20), the conveying mechanism 21 and the recording head 22 are same as those used in the fifth embodiment shown in FIG. 10.

Incidentally, the recording mode set in the recording mode setting unit 13 is set based on the parameters such as the resolution, the conveying speed of the recording medium and the amount of the jetting of the ink.

Next, an operation of the present invention will be described.

The input image data sent to the inkjet recording device 23 is decoded as predetermined, converted into a pixel value and so on, in the image processing data converter 2. The data related to the image to be recorded such as a pixel number is sent to the head driving unit 5. The data related to the size of a recording area of the image (recording size) is sent to the size identifying unit 26, respectively.

In the size identifying unit 26, the recording size of the image of the input image data is identified.

In the image quality level setting unit 14, a parameter corresponding to the image quality level, that is, so-called noise level, which is intended by a user, is inputted. Concretely, the parameter is represented as each level such as "HIGH QUALITY", "STANDARD" and "HIGH SPEED". Incidentally, when the level "HIGH QUALITY" is selected, the recording speed become slower, when the level "HIGH SPEED" is selected, the recording quality (image quality) become lower.

In the recording medium specifying unit 16, the type of the recording medium is specified.

In the recording mode setting unit 13, the recording mode is set based on the recording size identified in the size identifying unit 26, the image quality level set in the image quality level setting unit 14, the type of the recording medium specified in the recording medium specifying unit 16. The recording mode is specified based on, for example, the resolution, the number of the paths, the recording direction or the like, as shown in FIG. 12.

FIG. 12 provides the image qualities which are recognized by human eyes that the image qualities are nearly equal each other with respect to the various viewing distances, in the recording modes with respect to the various recording sizes respectively based on the particular recording medium and the particular image quality (noise) level. That is, the larger the recording size is, the farther the viewing distance is. Therefore, the resolution can be decreased and the conveying speed can be increased. Further, by decreasing the resolution and by increasing the conveying speed as described above, the recording speed can be increased. Accordingly, the problem that when the recording image is large, it takes a long time to recode the image, is solved.

Concretely, in FIG. 12, when the type of the recording medium (medium type) is specified as "PAPER OR VINYL CHLORIDE SYSTEM", the image quality level (noise level) is set as "HIGH QUALITY", and the recording size is identified as "210×297 mm (EQUIV. A4)", the recording mode setting unit 13 sets the viewing distance from which the image is viewed as approximately "300 mm". Accordingly, the recording mode setting unit 13 sets the recording mode where the resolution is "1200×2400 dpi" and the conveying speed is "75 mm/s". In addition to that, parameters such as scan speed and an amount of the jetting of the ink are also set.

As for the recording mode set in the recording mode setting unit 13, when the image quality level is increased even if the recording sizes are the same, the resolution is increased, and then, the conveying speed is decreased. Furthermore, dot diameters of the ink after the landing onto the recording medium differ each other among the plurality of recording medium according to the difference of the type of the recording medium even if the recording sizes and the image quality levels are respectively the same. That is, for example, the dot diameter of the ink after the landing onto the recording medium of the polyethylene terephthalate (PET) tends to be larger than that of the paper. Therefore, as for the recording mode for the PET, compared with that for the paper, the conveying speed is increased even if both resolutions are same each other. By controlling the recording quality (image quality) and the recording speed as above, the recording having a good balance between the actually demanded recording quality and productivity, can be performed easily.

The control unit 19 activates the conveying mechanism 21 according to the conveying speed determined based on the recording mode set in the recording mode setting device 3, in the same way as the above-described fifth embodiment. Further, the control unit 19 sends a driving control signal to the head driving unit 20. Then, the head driving unit 20 sends a driving signal to the recording head 22, the driving signal driving the recording head 22 for the recording the data related to the image to be recorded which is obtained in the image processing data converter 2 according to the driving control signal, that is, according to the resolution determined based on the recording mode and, as needed, the amount of the jetting of the ink.

The conveying mechanism 22 jets the ink toward the recording medium according to the driving signal sent from the head driving unit 20, that is according to the resolution set based on the recording mode and, as needed, the amount off the jetting of the ink. Further, the landed ink is cured by irradiation of a light, as needed.

According to the present embodiment, the recording mode is determined based on not only the image quality level inputted by a user, but also the consideration of the recording size. By performing the recording based on the recording mode, the recording having a good balance between the actually demanded recording quality and productivity, can be performed.

Further, if the recoding mode is defined based on the conveying speed of the recording medium conveyed by the conveying mechanism 21, and the conveying speed of the recording medium is adjusted based on the recording mode, the recording quality and the recording speed can be controlled. Consequently, the recording having a good balance between the actually demanded recording quality and productivity, can be performed easily.

Further, by setting the recording mode according to the type of the recording medium, the recording mode can be changed also according to the difference of the type of the recording medium, for example, whether the ink permeability of the recording medium is high or low. Consequently, the recording having a good balance between the actually demanded recording quality and productivity, can be performed easily.

Further, if the host system 9 or the external device 10 performs the setting of the viewing distance and, as needed, the setting of the image quality level and the specifying of the type of the recording medium, the specifying of the recording mode can be controlled from a remote place.

The entire disclosure of Japanese Patent Application No. Tokugan 2003-114475 filed on Apr. 18, 2003 and No. 2003-114496 filed on Apr. 18, 2003 including specification, claims, drawings and summary are incorporated herein by reference in its entirety.

What is claimed is:

1. An inkjet recording device comprising:

a recording head provided with a nozzle for jetting ink, wherein the inkjet recording device records an image by jetting the ink from the recording head onto a recording medium, while moving the recording head and the recording medium relatively, and the inkjet recording device further comprises, a viewing distance setting unit for setting a parameter corresponding to a distance from which the recording medium after a recording is viewed;

a recording mode setting unit for setting a recording mode based on the parameter set by the viewing distance setting unit; and a control device for controlling an operation of a jetting of the ink by the recording head and the relative movement of the recording head and the recording medium so that the recording is performed according to the recording mode set by the recording mode setting unit.

2. The inkjet recording device of claim 1, further comprising a head scanning mechanism for making the recording head scan in a direction perpendicular to a conveying direction of the recording medium, wherein the recording mode set by the recording mode setting unit is the number of scans of the recording head which is required to record a predetermined area in the conveying direction of the recording medium.

3. The inkjet recording device of claim 1, further comprising a head scanning mechanism for making the recording head scan in a direction perpendicular to a conveying direction of the recording medium, wherein the recording mode set by the recording mode setting unit is any one of a two-way recording for performing the recording by jetting the ink from the recording head in both directions of a back-and-forth scan of the recording head by the head scanning mechanism, or a one-way recording for performing the recording by jetting the ink from the recording head in one direction of a back-and-forth scan of the recording head by the head scanning mechanism.

4. The inkjet recording device of claim 1, further comprising a head scanning mechanism for making the recording head scan in a direction perpendicular to a conveying direction of the recording medium, wherein the recording mode set by the recording mode setting unit is a scan speed of the recording head by the head scanning mechanism.

5. The inkjet recording device of claim 1, wherein the nozzle is formed extending along a recording width of the recording medium, the inkjet recording device further comprises a conveying mechanism for conveying the recording medium in a direction perpendicular to the recording width, and the recording mode set by the recording mode setting unit is a conveying speed of the recording medium by the conveying mechanism.

6. The inkjet recording device of claim 1 wherein the recording mode set by the recording mode setting unit is a recording resolution.

7. The inkjet recording device of claim 1, further comprising an image quality level setting unit for setting an intended image quality level of the image to be recorded, wherein the recording mode setting unit sets the recording mode based on the parameter set by the viewing distance setting unit and the image quality level set by the image quality level setting unit.

8. The inkjet recording device of claim 1, further comprising a recording medium specifying unit for specifying a type of the recording medium, wherein the recording mode setting unit sets the recording mode based on the parameter set by the viewing distance setting unit and the type of the recording medium specified by the recording medium specifying unit.

9. The inkjet recording device of claim 1, further comprising an interface for connecting with an external device, wherein an input for the setting in the viewing distance setting unit is performed in a computer system connected to the interface directly or through a predetermined network.

10. The inkjet recording device of claim 7, further comprising an interface for connecting with an external device, wherein an input for the setting in the image quality level setting unit is performed in a computer system connected to the interface directly or through a predetermined network.

11. The inkjet recording device of claim 8, further comprising an interface for connecting with an external device, wherein an input for the setting in the recording medium specifying unit is performed in a computer system connected to the interface directly or through a predetermined network.

12. The inkjet recording device of claim 1, wherein the ink is photocurable ink cured by irradiation of a light, and the inkjet recording device further comprises a light source for irradiating the light onto the photocurable ink jetted from the recording head and landed on the recording medium.

13. The inkjet recording device of claim 12, wherein the photocurable ink is UV curable ink cured by irradiation of a ultraviolet ray, and the light source is an UV light source for generating the ultraviolet ray.

14. The inkjet recording device of claim 13 wherein the UV curable ink is ink comprising a cationic polymerizable compound.

* * * * *

UNITED STATES PATENT AND TRADEMARK OFFICE

CERTIFICATE OF CORRECTION

PATENT NO. : 7,175,246 B2
APPLICATION NO. : 10/825555
DATED : February 13, 2007
INVENTOR(S) : Yukihiro Niekawa It is certified that error appears in the above-identified patent and that said Letters Patent is hereby corrected as shown below:

On the Title page:

Item (75) Inventors, change "Yakihiro Niekawa" to --Yukihiro Niekawa--.

Signed and Sealed this

First Day of May, 2007

JON W. DUDAS
*Director of the United States Patent and Trademark Office*